US008602387B2

(12) United States Patent
Wrigley et al.

(10) Patent No.: US 8,602,387 B2
(45) Date of Patent: Dec. 10, 2013

(54) VALVE FOR FLOWABLE MATERIAL AND A CLOSURE THEREOF

(75) Inventors: Andrew Nicholson Wrigley, Auckland (NZ); Yeong-Heng Koo, Auckland (NZ); Matthew James Towers, Auckland (NZ)

(73) Assignee: ITW New Zealand Limited, Auckland (NZ)

( * ) Notice: Subject to any disclaimer, the term of this patent is extended or adjusted under 35 U.S.C. 154(b) by 1087 days.

(21) Appl. No.: 12/091,760

(22) PCT Filed: Nov. 9, 2006

(86) PCT No.: PCT/IB2006/003166
§ 371 (c)(1),
(2), (4) Date: Apr. 28, 2008

(87) PCT Pub. No.: WO2007/054797
PCT Pub. Date: May 18, 2007

(65) Prior Publication Data

US 2008/0283790 A1 Nov. 20, 2008

(30) Foreign Application Priority Data

Nov. 11, 2005 (NZ) ..... 543568
Dec. 23, 2005 (NZ) ..... 544498

(51) Int. Cl.
*F16K 31/00* (2006.01)

(52) U.S. Cl.
USPC ..... 251/339; 222/518; 222/541.9

(58) Field of Classification Search
USPC ..... 251/339, 144, 342; 222/522, 518, 566, 222/541.9
See application file for complete search history.

(56) References Cited

U.S. PATENT DOCUMENTS

| | | | | | |
|---|---|---|---|---|---|
| 3,263,875 | A | * | 8/1966 | Lofdahl | 222/518 |
| 3,433,456 | A | * | 3/1969 | Mueller | 251/339 |
| 3,595,445 | A | | 7/1971 | Buford et al. | |
| 3,730,224 | A | * | 5/1973 | Prisk | 137/625.33 |
| 4,169,548 | A | * | 10/1979 | Bond | 222/505 |
| 4,452,425 | A | * | 6/1984 | Lucking | 251/144 |
| 4,527,703 | A | * | 7/1985 | Cummings | 215/232 |
| 4,687,123 | A | * | 8/1987 | Hyde | 222/518 |
| 4,711,380 | A | * | 12/1987 | Ulm | 222/153.07 |
| 5,000,359 | A | * | 3/1991 | Scholle et al. | 222/505 |
| 5,797,524 | A | * | 8/1998 | Lentz | 222/505 |

(Continued)

FOREIGN PATENT DOCUMENTS

| | | |
|---|---|---|
| FR | 2803829 A1 | 7/2001 |
| GB | 2082152 A | 3/1982 |
| GB | 2283077 A | 4/1995 |

OTHER PUBLICATIONS

ISR for PCT/IB2006/003166 dated Mar. 27, 2007.

*Primary Examiner* — John K Fristoe, Jr.
*Assistant Examiner* — Andrew J Rost
(74) *Attorney, Agent, or Firm* — Lowe Hauptman & Ham, LLP

(57) ABSTRACT

This invention provides a valve for a flowable material. The valve has a body defining a bore defined therein. An opening is defined in the side of the bore for material to flow from the bore. The valve also has an actuatable member which is movable along the bore to control the extent of an uncovered area of the opening defined in the bore to control the flow of material through the opening.

28 Claims, 21 Drawing Sheets

(56) References Cited

U.S. PATENT DOCUMENTS 6,131,767 A * 10/2000 Savage et al. ..... 222/1
6,296,157 B1 * 10/2001 Erb ..... 222/509
6,360,925 B2 * 3/2002 Erb ..... 222/509
6,648,186 B2 * 11/2003 Roethel et al. ..... 222/509
7,040,514 B2 * 5/2006 Colan et al. ..... 222/402.13
D553,982 S * 10/2007 Erb ..... D9/447

* cited by examiner

VALVE FOR FLOWABLE MATERIAL AND A CLOSURE THEREOF

RELATED APPLICATIONS

The present application is based on International Application Number PCT/IB2006/003166 filed Nov. 9, 2006, and claims priority from New Zealand Application Number 544498 filed Dec. 23, 2005 and New Zealand Application Number 543568 filed Nov. 11, 2005, the disclosures of which are hereby incorporated by reference herein in their entirety.

TECHNICAL FIELD

This invention relates to a valve for flowable materials. In particular it relates to a low-cost valve for dispensing fluid. Further in particular it relates to injection moulded valves.

BACKGROUND ART

Various fluid packages are provided with valves for taps to allow fluid to be dispensed.

Many of these fluid packages are used in a disposable or semi-disposable manner. These types of packages are generally manufactured using economical materials and methods. Disposable or semi-disposable packages require valves to allow their contents to be dispensed. These valves must be manufactured with materials and methods that are similarly economical to those of the packages. This need for economically manufactured valves has created the field of plastic injection moulded valves.

Although it is desirable for packages and valves to be economical to manufacture, they are also often required to be highly reliable. For example, leakage of valves can lead to significant damage to packaged product inventories. Leakage of packages through the valves may also make a packaged product undesirable to consumers.

Thus, there is a continual need to reduce the cost of manufacture while maintaining reliability of these valves.

A variety of valves suitable for fluid packages are known. Most of these have a bore or conduit which is closed at one end by a movable valve element.

One valve known in the industry is disclosed in U.S. Pat. No. 6,360,925 entitled "Liquid Dispending Tap". This valve has an opening in the side of a bore that is closed by a movable valve member. This tap has a ridged body which has an opening for dispensing liquid and is provided with a control member which moves a closure element towards and away from the opening inside of the body transverse to the axis of the body. The tap is provided with a button which, if depressed towards the body, actuates movement of a control member to uncover a fluid outlet. The body of the tap is approximately barrel shaped with the outlet in the side of the barrel.

The control member moves transverse to the barrel and toward or away from the outlet which is formed in the side of the body. When the barrel is closed the control member covers and blocks the outlet. The control member is actuated by a button that moves inline with the barrel. The tap includes an actuation mechanism that transfers force between the directions of movement of the button and the control member, which are perpendicular to each other. The mechanism also spring loads the control member against the fluid outlet so the valve is closed when the button is released.

This actuation mechanism is relatively intricate and requires careful installation within the valve. Relatively fine features are moulded into the body of the valve to provide mountings for the mechanism, and an end of the hollow body near the button needs to be sealed by a resilient membrane.

A limitation of this type of tap is that it requires careful and costly assembly, particularly where the actuation mechanism for actuating the control member via the button is concerned.

Another limitation of this tap is that the hollow body is sealed only by a resilient membrane, the design of which provides only limited resistance to the transfer of gases. This may allow eventual oxidisation of fluids within the tap.

Another limitation of this type of tap is that it requires relatively fine moulding features for the control member actuation mechanism within the body. This may possibly result in a reduced lifetime or increased cost for injection moulding tools for the tap. The fine mouldings and the spring loading function of moulded parts may also require relatively expensive materials to be used.

Another disadvantage of this type of tap is that it requires a minimum of four to five parts. There would be significant advantage in a tap which provided a similar function but which had fewer parts using low cost resins only.

A further disadvantage of this type of tap is that the spring load provided by the mechanism may provide limited sealing of the outlet by the control member, particularly where inward pressure on the outlet is concerned. This is due to the construction and use of a soft sealing valve seat.

Accordingly, it is an object of the present invention to overcome or mitigate some of the limitations in existing fluid taps or valves, or at least provide the public with a useful choice in fluid dispensing taps or valves.

It is a further object of the present invention to provide a valve for flowable material that requires only three parts, or at least provides a public with a useful choice in valves for flowable material.

It is a yet further object of the present invention to provide a valve for flowable materials that provides robust sealing of its outlet, or at least to provide the public with a useful choice in valves for flowable material.

Further aspects and advantages of the present invention will become apparent from the ensuing description which is given by way of example only.

As used herein the term 'bore' is intended to refer to a space formed by a member of the valve, where the space is adapted to receive another member of the valve and allow it to move along the space. The space may or may not be circular in cross-section.

As used herein the term 'flow opening' is intended to be inclusive of both an inlet or an outlet of a bore.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications may be referred to herein, this reference does not constitute an admission that any of these documents form part of the common general knowledge in the art in New Zealand or in any other country.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

DISCLOSURE OF INVENTION

According to one aspect of the present invention there is provided a valve for a flowable material including:

a body having a bore formed therein, the bore having a flow opening in the side thereof; and an actuatable member capable of covering at least a portion of the flow opening, the actuatable member being movable along the bore to control the extent of an uncovered area of the flow opening and thereby control the flow of material between the bore and the flow opening.

Preferably, the actuatable member has an outer profile of a complementary shape to said bore.

Preferably, the valve includes a seal formed between the actuatable member and the bore to prevent flow of material between the bore and the actuatable member.

Preferably, the bore is a rib.

Preferably the rib is formed on the actuatable member.

Preferably, a button is formed by an end portion of the actuatable member.

Preferably, the button is capable of being depressed parallel to said bore.

Preferably, the body includes a button opening adapted to allow the button to protrude therethrough.

Preferably, the valve includes a diaphragm seal to seal said opening.

Preferably, the valve is adapted so that the diaphragm seal is abutted by the body and/or button to provide a barrier against the transfer of gases through the diaphragm seal said barrier being additional to a barrier provided by said diaphragm seal.

Preferably, the valve includes a biasing means to bias the actuatable member towards a position that fully covers said flow opening formed in the bore and thereby prevents inadvertent flow of material through the flow opening.

Preferably, the diaphragm seal is adapted to provide the biasing means for the valve. This reduces the part count of the valve as the diaphragm seal serves the purpose of both a seal and a bias means. This arrangement allows a complete valve to be provided using only three simple parts: housing, diaphragm seal and actutable member (which includes a button).

Preferably, the diaphragm seal is formed from an elastomer material.

Preferably, the diaphragm seal is adapted to fold back on itself when the actuatable member is towards a position which does not cover the flow opening in a side of the bore.

Preferably, the body and diaphragm seal are formed with co-operating or complementary shapes at regions at which they abut. This minimises the surface area of the diaphragm seal so that as much as possible any gases transferring through the diaphragm seal would also have to be transferred through part of the body. This feature reduces the volume of gases that are transferred through the diaphragm into or from the material in the valve.

Preferably, the body includes at least one guard protrusion positioned near the button and extending substantially parallel to a direction of actuation of the button. This guard protrusion feature may guard against inadvertent depression of the button.

Preferably, the body includes at least one surface projecting substantially perpendicular to the button which is adapted for a user to grip when depressing the button.

Preferably, the actuatable member includes a flow-path therethrough for the flowable material to flow within the bore and out of the flow opening in a side of the bore.

Preferably, when the opening is not covered by the actuatable member, a flow-path formed for the material extends through the actuatable member.

Preferably, the diaphragm seal is adapted to be fitted within an end of the bore.

Preferably, at least one rib and/or groove may be formed in the diaphragm seal to fasten the diaphragm seal within the bore.

Preferably, at least one rib and/or groove may be formed in the diaphragm seal to fasten the diaphragm seal over the button.

Preferably, the outlet conduit extends in a direction away from the body.

Preferably, the outlet conduit extends at an angle to the body.

Preferably, the outlet conduit extends towards the user actuated portion of the valve for flowable material.

Preferably, the outlet conduit extends at an angle of substantially 45 degrees to a central axis of the bore.

Preferably, the body may be adapted for connection of a cover adapted to sit over the button.

Preferably, the cover may be connected by tamper evident filaments adapted to break to allow part of the cover to be removed from the body to expose the button.

According to another aspect of the present invention, there is provided a valve for a flowable material including:

a body having a bore formed therein and button opening formed therein for a button capable of controlling the flow of material through the valve; and a diaphragm seal for said button opening, wherein said diaphragm seal provides biasing of said button to said position corresponding to a said flow of material through the valve being shut-off.

According to a further aspect of the present invention there is provided a valve for a flowable material including:

a body having a bore formed therein;

an actuatable member, having an outer surface formed as a bush for the bore, provided in said bore, said actuatable member being movable within said bore; and a flow opening formed in a side of said bore, wherein the actuatable member may be positioned within said bore to control a flow of material through said flow opening.

According to another aspect of the present invention there is provided a valve for flowable material including:

an opening;

a button substantially perpendicular to the opening;

a removable closure which includes a button covering portion to cover the button and an opening covering portion to cover the opening and a web joining the button covering portion and the opening covering portions.

Preferably the button covering portion comprises the recess for the button.

Preferably the opening covering portion comprises a plug for the opening.

Preferably the button is provided in a recess and the recess is adapted to receive the button covering portion to fix the button covering portion over the button.

Preferably the recess includes an undercut adapted to engage a sealing head on the button covering portion to substantially seal the button covering portion over the button.

Preferably the recess includes frangible filaments adapted to allow removable connection of the button covering portion to the recess.

According to another aspect of the present invention there is provided a closure for a valve including:

a button covering portion adapted to cover the button;

a plug portion adapted to close the outlet conduit;

a web portion connecting said button covering portion and said plug.

Preferably the button covering portion includes a recess for the button and a recess engaging surface adapted to be engageable to fix the button covering portion in place over the button.

Preferably the recess engaging surface comprises a flange. The flange may comprise a sealing bead.

Preferably the closure portion is substantially concave with respect to a side of the closure, to receive the button, and is substantially convex with respect to the same side of the closure, to be insertable into an opening.

Preferably the closure includes a pull-tab.

Preferably the pull-tab is connected to the opening covering portion.

Preferably the closure is formed from a resilient material.

According to another aspect of the present invention there is provided a valve for flowable material comprising:

a body;

a button extending from the body;

wherein the body includes at least one projection providing a gripping surface substantially transverse to the button and a guard surface substantially further from the body than the button extends.

Preferably the at least one projection extends substantially at 45 degrees from the button.

BRIEF DESCRIPTION OF DRAWINGS

Further aspects of the present invention will become apparent from the following description which is given by way of example only and with reference to the accompanying drawings in which.

BEST MODES FOR CARRYING OUT THE INVENTION

Figure 1:
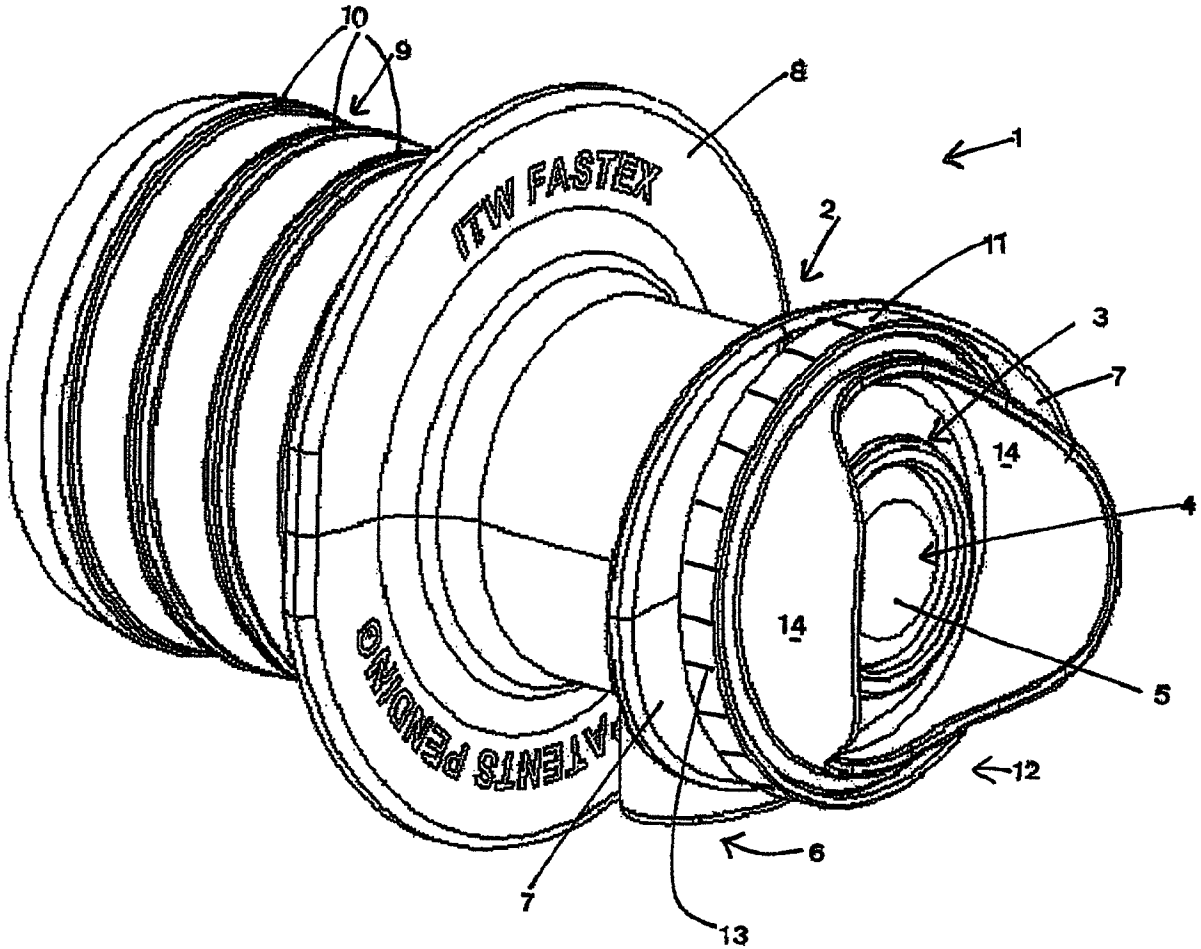
FIG. 1 is a perspective view of the valve for flowable material according to a preferred embodiment of the present invention.

FIG. 1 shows a perspective view of the outside of a preferred embodiment of valve 1 for flowable material such as fluids. The valve 1 has a body 2, which is typically formed as a single integrally moulded element. Typically the body 2 is formed by injection moulding. The body 2 has a button opening or end opening 3 through which a button 4 projects. The button depicted in FIG. 1 is actually behind a diaphragm seal 5 (better seen in FIG. 2).

In use, fluid exits an outlet 6 when the button 4 covered by the diaphragm seal 5 is pressed.

A pair of wing-like projections 7 are formed on the body 2 near the button opening 3 to provide convenient surfaces, transverse to the body, for an operator to grip with their index and middle fingers while depressing the button 4 with their thumb.

The body 2 has two guard projections 14 extending out from the front 12 of the body 2. These guard projections 14 prevent the button 4 being inadvertently depressed when the front 12 of the valve 2 is pressed against a flat surface, such as a wall, during storage.

The body 2 is provided with a flange 8 to assist in attaching the valve to a fluid container (not shown). The rear 9 of the body 2 is barrel shaped and is provided also for use in fastening the valve 1 to a container (not shown). The rear 9 of the body may have ribs 10 to assist in securing the rear 9 of the body 2 in the container (not shown).

FIG. 1 also shows a ring 11 which is the remaining part of a cap (not shown in FIG. 1) which covers the front 12 of the valve 2 according to an alternative embodiment of the present invention. The ring 11 shows the remains of tamper evident filaments 13. These filaments are bonded to the ring 11 and are designed to be snapped by twisting of the cap. The valve 1 may or may not be provided with a ring 11.

Figure 2:
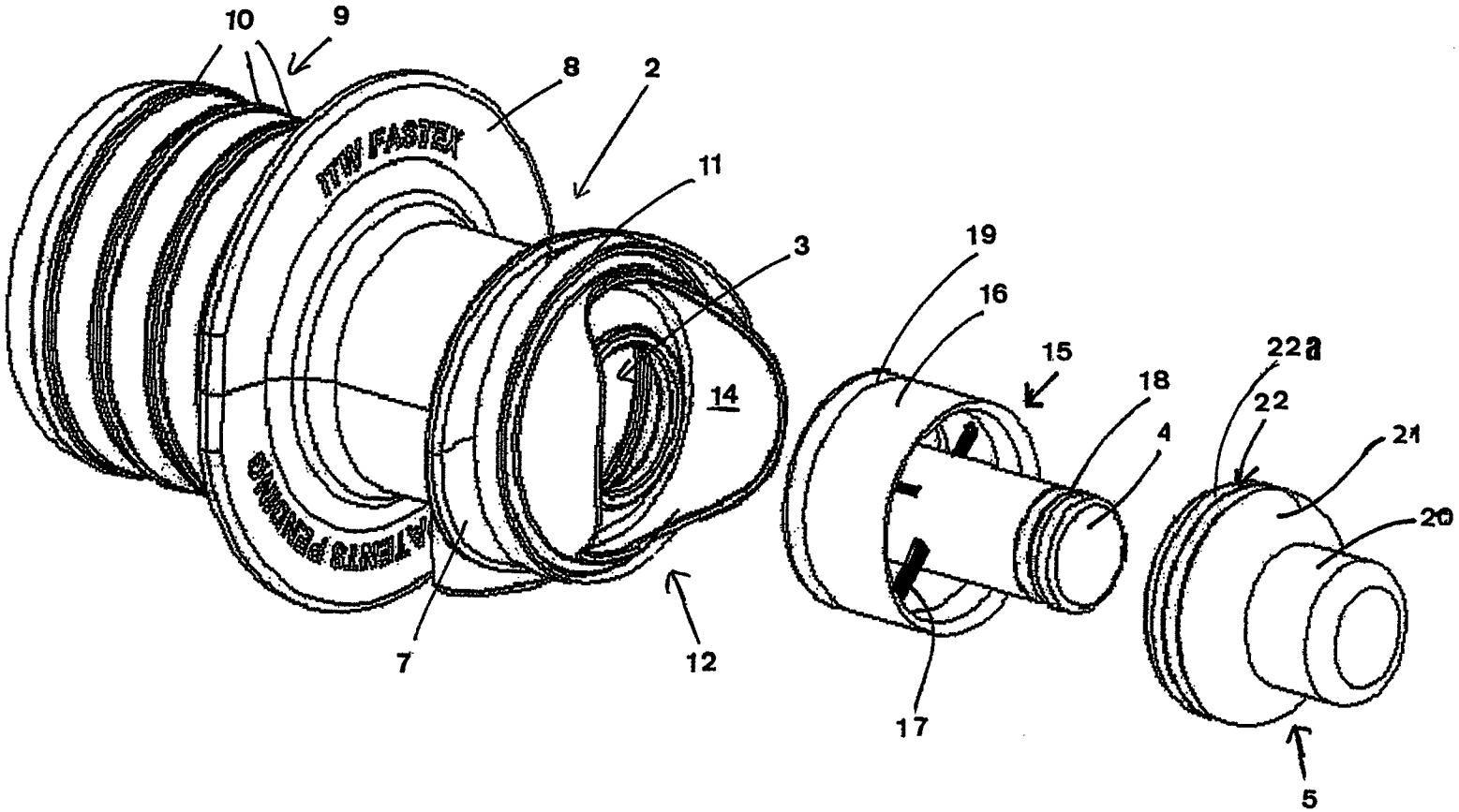
FIG. 2 is a perspective view of the three component parts of a valve for a flowable material according to a preferred embodiment of the present invention.

FIG. 2 is a perspective view of the disassembled parts that make up a preferred embodiment of the present invention.

The valve 1 includes an internal member 15 which, comprises an actuatable or actuated member 16 and a button 4. In the preferred embodiment the internal member 15 is a single integral part. However, embodiments are envisioned in which the actuatable member 16 and button 4 are formed as separate connectable members.

The internal member 15 has a set of spokes 17 attaching the actuated member 16 to the button 4. Otherwise, the actuated member 16 is a hollow annular shape designed to fit snug in a bore (shown later) formed in the body 2.

The button 4 has a groove 18 which engages a corresponding rib (shown later) on the inside of the diaphragm seal 5, so that the button 4 firmly engages the diaphragm seal 5. This allows force to be transferred from the button to the seal to compress the seal 5 or, alternatively, for the diaphragm seal 5 to pre-load or bias the button 4.

A seal in the form of a lip or rib projection 19 is also formed on the actuated member 16 to provide a seal between the actuated member 16 and the bore (shown later) into which the actuated member 16 is fitted. Alternatively, some similar form of seal may be provided on the actuated member, or the seal may be provided on or in the bore. Various suitable seals between the actuatable member 16 and the bore 23 will be apparent to those skilled in the art. By way of example only these might include flaps or O-rings.

The diaphragm seal 5 is shown having a button covering portion 20, a dome shaped portion 21 and a fastening portion 22. The fastening portion 22 has formed thereon a groove 22*a* which mates with a ridge (not shown) formed on the body 2.

Figure 3:
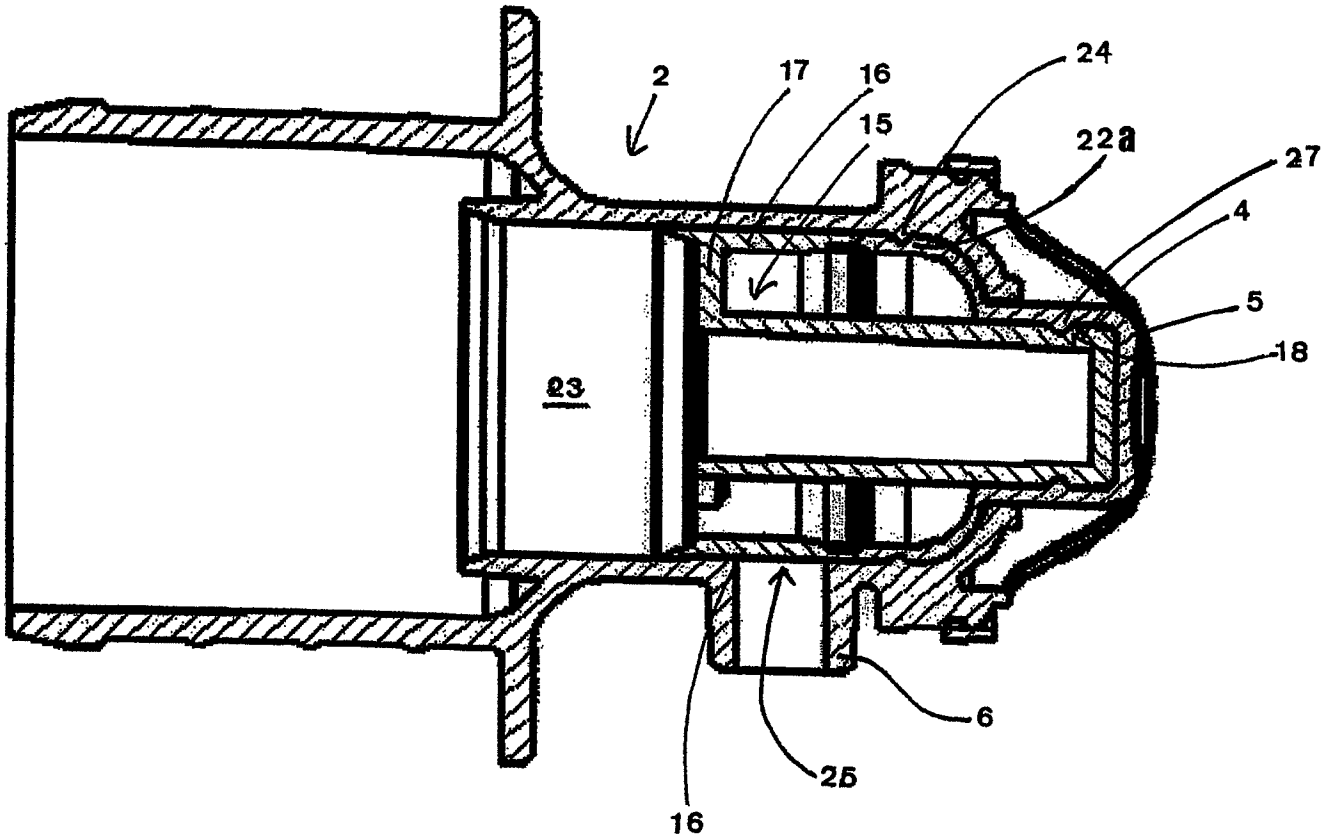
FIG. 3 is a cutaway side elevation of a valve for flowable material according to the same preferred embodiment of the present invention as FIGS. 1 and 2.

FIGS. 2 and 3 show that only three separately formable parts are required to form the valve 1 according to the preferred embodiment of the present invention.

FIG. 3 shows a cutaway side elevation of a valve 1 according to a preferred embodiment of the present invention, and shows the inter-relationship of the body 2, diaphragm seal 5 and internal member 15.

Also shown in FIG. 3 is a ridge 27 formed on the button portion 4 of the internal member 15 that mates with a groove 18 in diaphragm 5 to secure the diaphragm 5 onto the button 4.

FIG. 3 also shows an internal bore 23 formed in the body 2 into which the actuatable member 16 of the internal member 15 is snugly fitted. The outside surface of the actuatable member 16 is formed into a complementary shape for the bore 23 which, in this embodiment, is circular in cross section.

In this embodiment the outside surface of the actuatable member 16 forms a bush for the bore 23 that is movable along the bore 23. The material is prevented from flowing around the outside of the actuatable member 16 by the rib 19 (shown in FIG. 2) which seals against the inside of the bore 23. This allows a good seal to be formed between two injection moulded components, such as the body 2 and actuatable member 15, which normally have large manufacturing tolerances.

Other embodiments are envisioned in which the bore 23 is non-circular in cross-section. However, a circular cross-section is chosen for the preferred embodiment as it minimises the contact area, and thus friction, between the actuatable member 15 and the bore 23.

FIG. 3 also shows how the diaphragm seal 5 fits into an end of the body 2. A rib 24 is formed in the inside of the body 2 to mate with a groove 22*a* formed in the diaphragm seal 5. This rib and groove arrangement holds the diaphragm seal 5, which is formed from a resilient material, in place in the bore 23.

FIG. 3 shows that the diaphragm seal 5 serves to seal the end of the bore 23 to stop fluid within the valve 1 escaping past the button 4.

FIG. 3 also shows the outlet 6 which communicates with a flow opening 25 formed in a side of the bore 23. Here the flow opening 25 is the junction of the bore 23 and outlet 6.

FIG. 3 shows the opening 25 covered (and thereby blocked) by the actuatable member 16. In this configuration, flow of fluid through the flow opening 25 to the outlet 6 is prevented and the valve may be described as closed.

Figure 4:
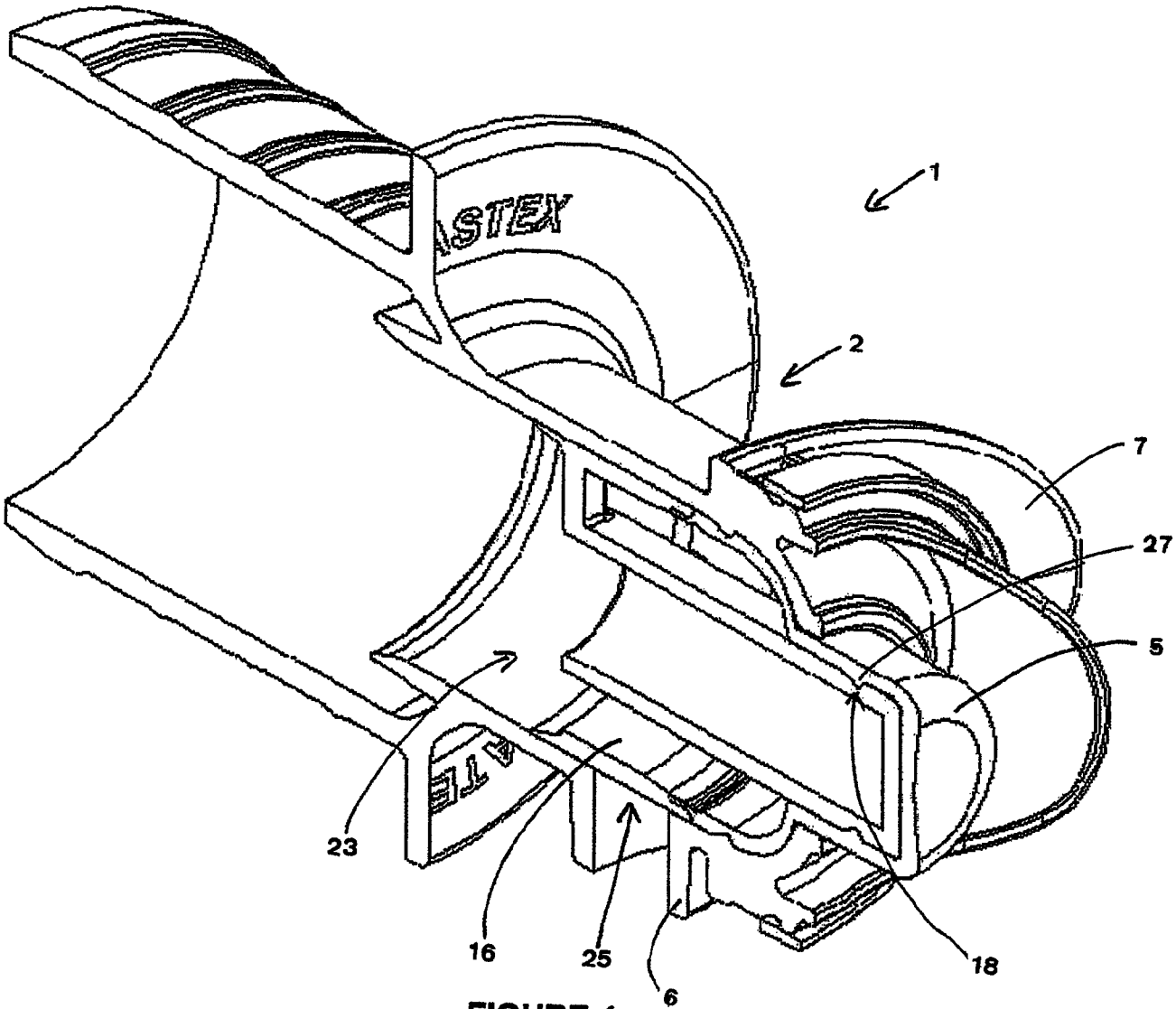
FIG. 4 is a cutaway perspective of a valve for flowable material according to the same preferred embodiment of the present invention as FIGS. 1 to 3, in this case the valve is closed.
Figure 5:
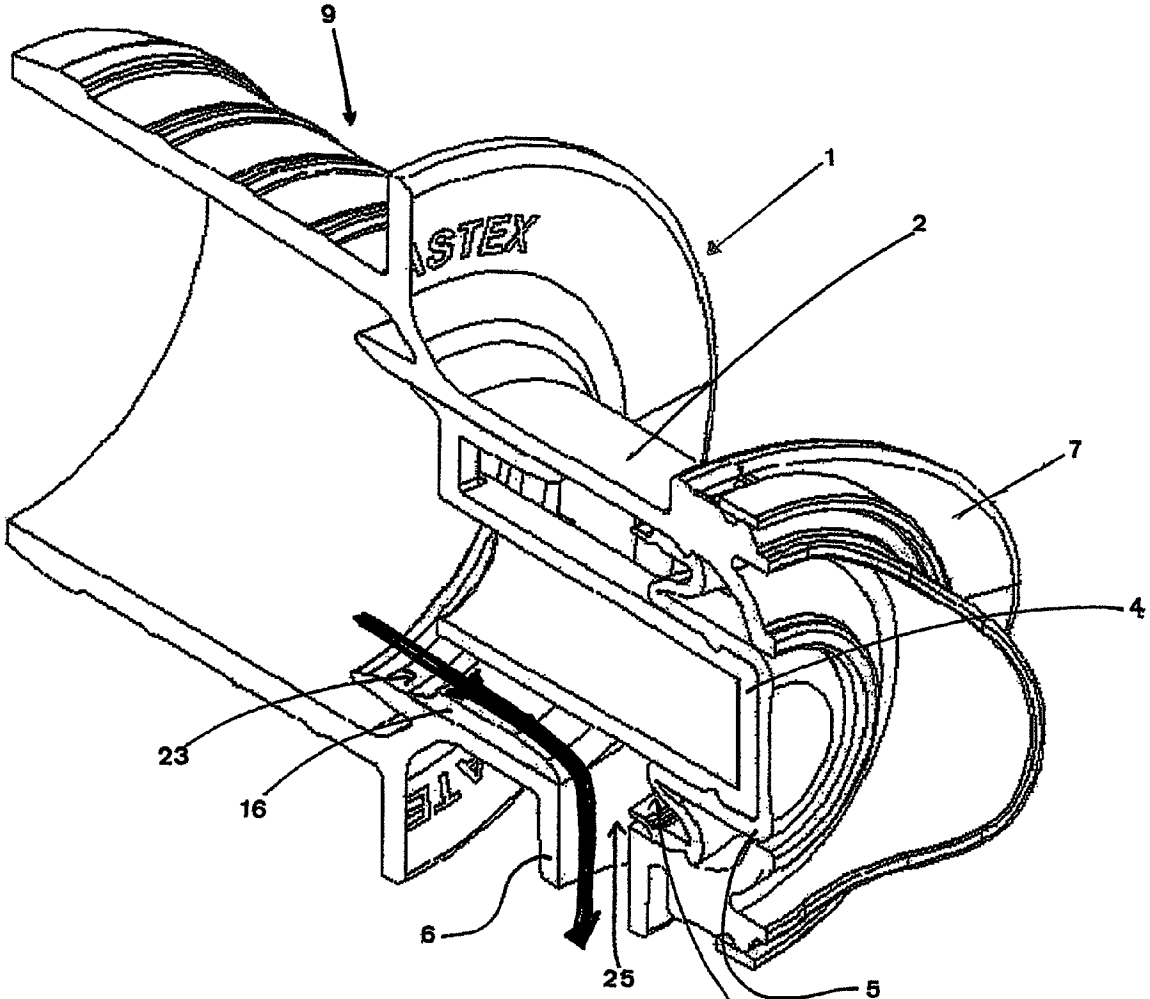
FIG. 5 is a cutaway perspective view of a valve for flowable material according to the same preferred embodiment of the present invention as FIGS. 1 to 4, in this case the valve is open and a flow-path through the valve is shown.

FIGS. 4 and 5 show cut-away perspective views of the valve 1 in a closed configuration, in FIG. 4, and an open configuration, in FIG. 5. In the closed configuration, the actuatable member 16 covers the flow opening 25 formed in the side of the bore 23 and any flow of fluid through the bore 23 and opening 25 and the outlet 6 is blocked.

FIG. 5 shows the actuatable member 16 pushed towards the rear 9 of the body 2 so that opening 25 is exposed. In the open configuration of the valve 1 fluid can flow through the rear 9 of the body 2 through the bore 23 and through and over the hollow annular actuatable element 16 then out through the opening 25 and outlet 6.

Figure 6:
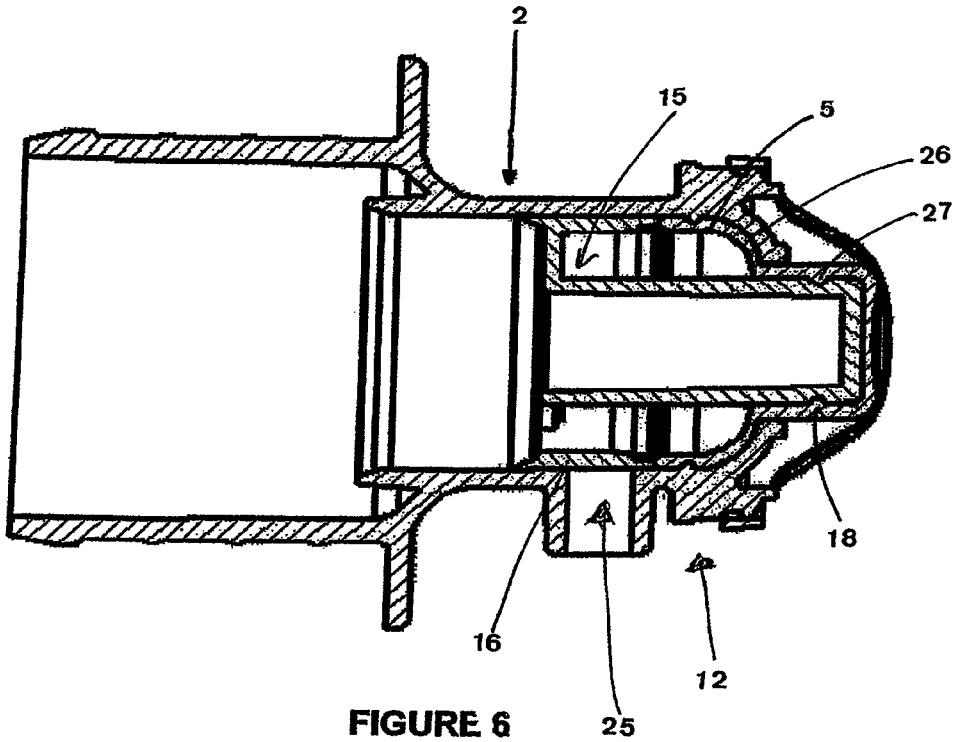
FIG. 6 shows a cutaway side elevation of a valve for flowable material according to the same preferred embodiment of the present invention as FIGS. 1 to 5.
Figure 7:
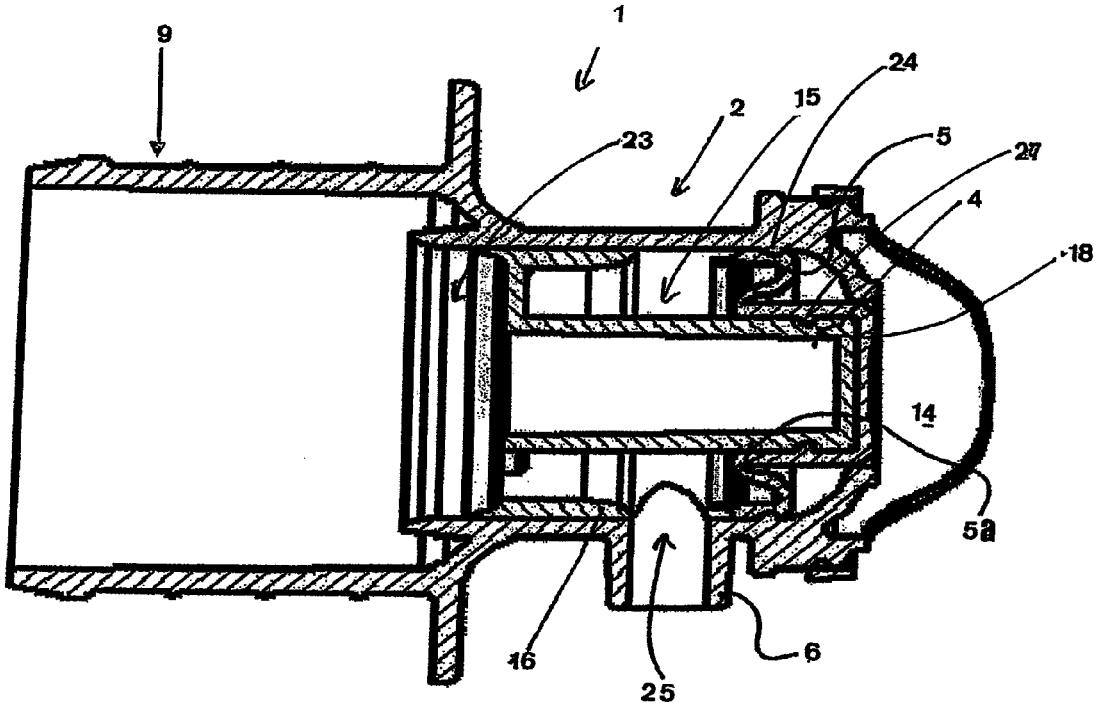
FIG. 7 shows a cutaway side elevation of a valve for flowable material according the same preferred embodiment of the present invention as FIGS. 1 to 6, where in this view, the valve is open.

FIGS. 6 and 7 show cut-away side elevations of the valve 1 according to a preferred embodiment of the present invention. The position of the internal member 15 and actuatable member 16 when the valve is in a closed configuration is depicted in FIG. 6. This is towards the front 12 of the body 2. The position of the internal member 15 and actuatable member 16 when the valve 1 is in an open configuration is depicted in FIG. 7.

It will be apparent to those skilled in the art that the actuatable member 15 may be moved to a position where it covers or uncovers only a portion of the flow opening 25 to control the rate of flow.

FIG. 7 shows that when the valve is in an open configuration, the diaphragm seal 5 is doubled back upon itself, the button 4 is depressed and the actuatable member 16 is moved away from the opening 25 toward the back 9 of the body 2. The diaphragm seal 5 is formed from a resilient material such as an elastomer material, for example. The resilient nature of diaphragm seal 5 and the doubled back shape of the diaphragm seal 5 when the valve is in an open configuration mean that the diaphragm seal 5 will tend to force, or bias, the button 4 and actuatable member 16 back towards the position they would assume when the valve 1 is in a closed configuration (as shown in FIG. 6). The diaphragm seal 5 typically has fold regions 5*a* so that the diaphragm seal 5 folds or doubles back consistently.

The ribs 24 and 27 and the corresponding grooves (22*a* and 18 seen best in FIG. 3) hold the diaphragm seal 5 securely in place with the body 2 and button 4.

Thus, the diaphragm seal 5 acts as a spring or biasing element to force or bias the button 4 to protrude from the button opening (not shown) and the actuatable member 16 towards covering the opening 25. This means the valve 1 closes when an operator releases the button 4. Those skilled in the art will realise that the biasing may be provided by a means separate to the diaphragm seal. However, combining the diaphragm and biasing means has the advantage of reducing the part count of the valve 1.

Referring to FIG. 6, the diaphragm seal 5 is in contact with a domed bore closure portion 26 of the body 2 (best seen in FIG. 2). The part of the diaphragm seal 5 that covers the button 4 protrudes through an aperture 3 in the body. From FIGS. 3 and 6, it can be seen that diaphragm seal 5 is, in all places, abutted against either the body 2 or the button 4. This means that any gases which might be transferred or dispersed through diaphragm seal 5 will also have to pass through either the body 2 or the button 4. This feature of the diaphragm seal in valve 1 reduces the transfer of gases through the valve 1 into the material within.

Figure 8:
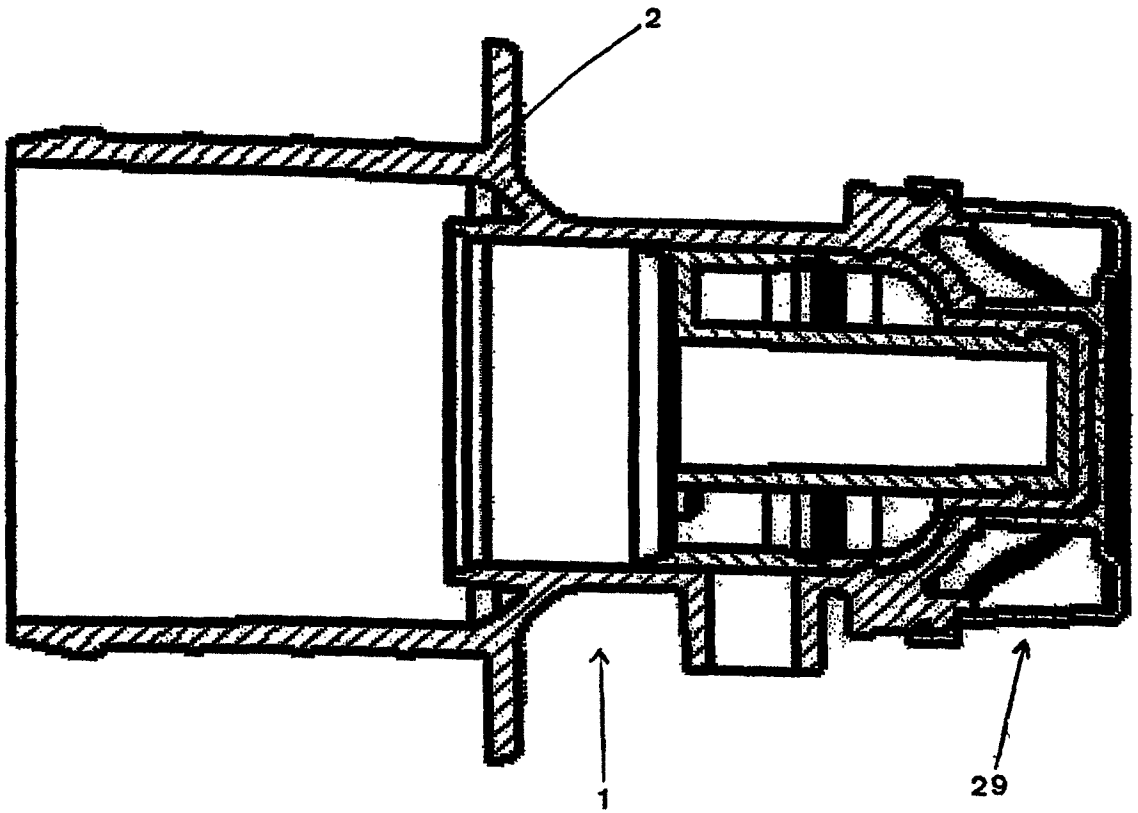
FIG. 8 is a perspective view of a valve for flowable material according to a second embodiment alternative to FIGS. 1 to 7 showing the addition of an optional protective cap over the button of the valve.

FIG. 8 shows a cut-away side elevation of an alternative embodiment of the present invention in which a protective cap 29 is attached to the body 2 by way of a ring 11 (best seen in FIG. 1).

Figure 9:
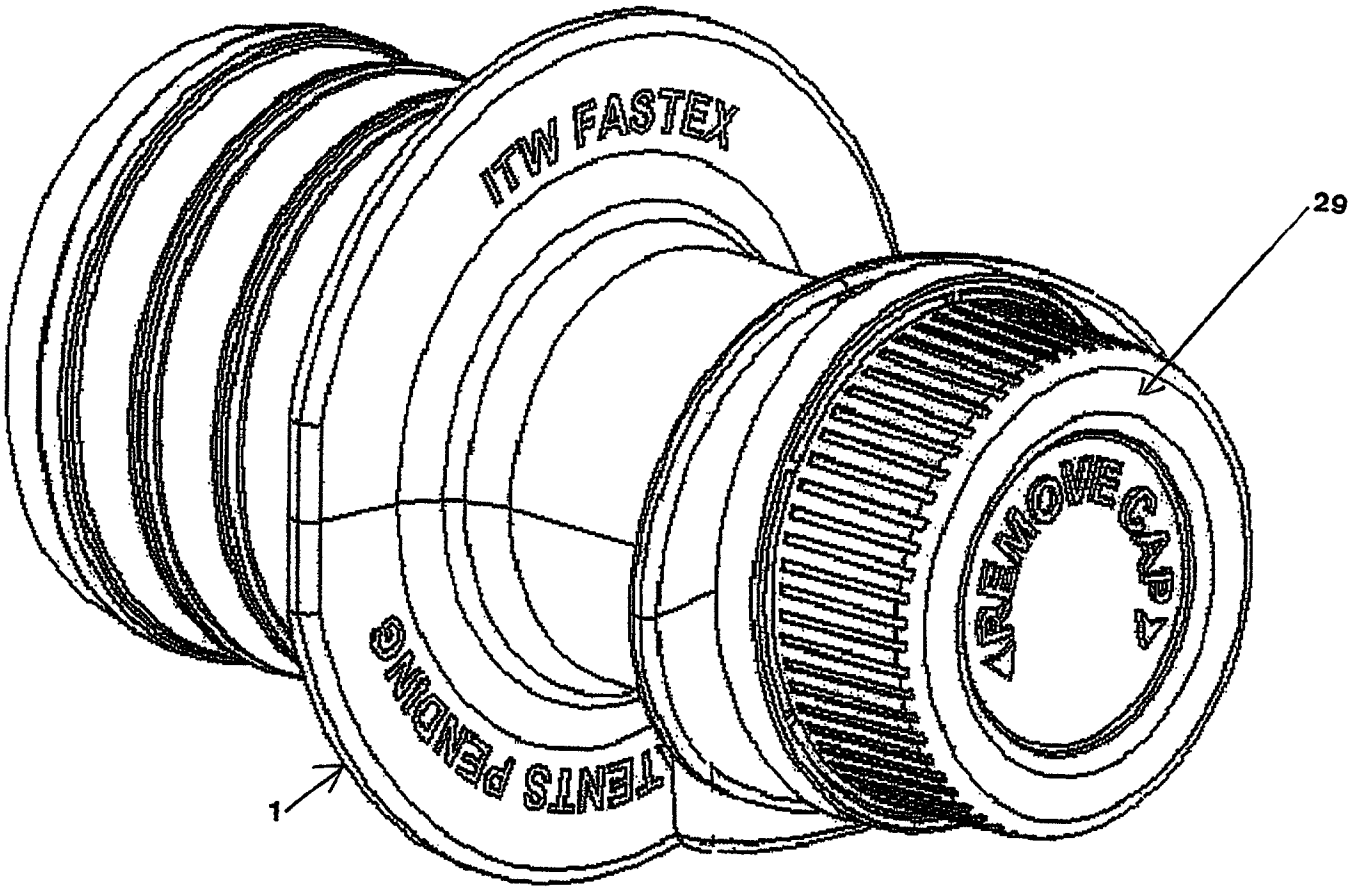
FIG. 9 is a perspective view of a valve for flowable material according to the second embodiment of the present invention shown in FIG. 8.

FIG. 9 shows a perspective view of the alternative embodiment of the present invention depicted in FIG. 8 which includes a cap 29 for the button 4.

Typically, the following materials are used in the preferred and alternative embodiments. The body 2, cap 29 and ring 11 are typically formed from polypropylene. The internal element 15 is typically formed from high density polyethylene. The diaphragm seal 5 is typically formed from polyester elastomer. Alternative materials with similar and suitable characteristics will be apparent to those skilled in the art.

Figure 10:
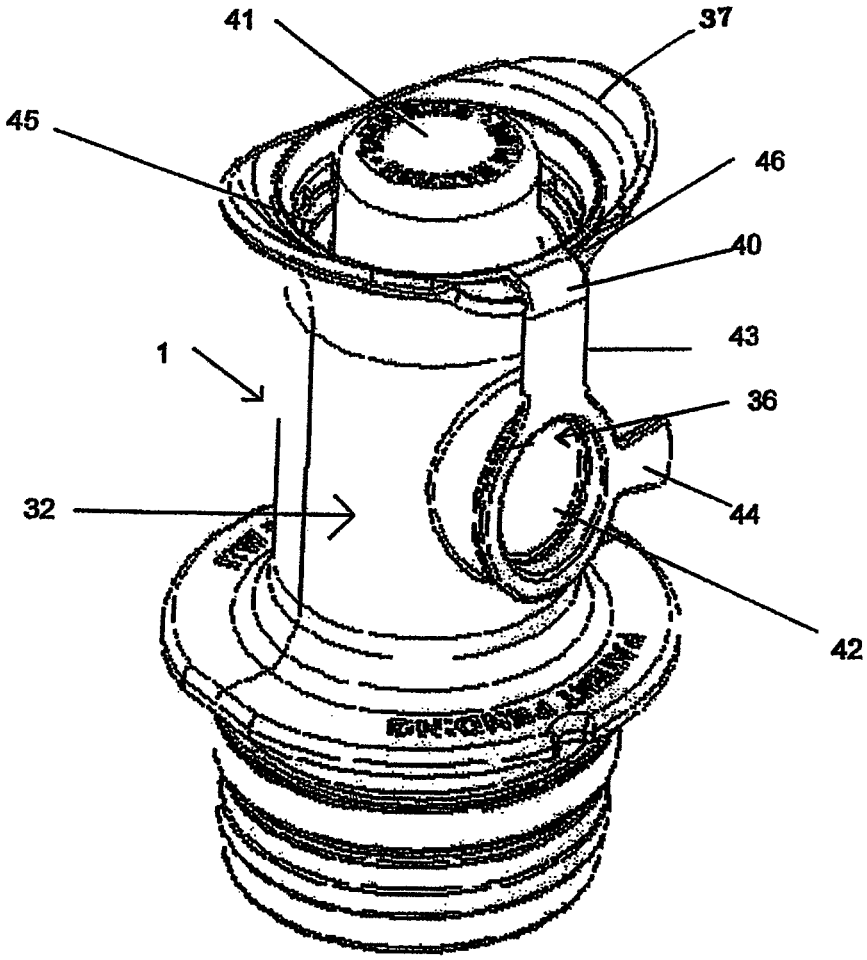
FIG. 10 is a perspective view of a valve for flowable material according to a third embodiment of the present invention.

FIG. 10 shows a perspective view of another alternative embodiment of a valve 1 for flowable material such as fluids. This embodiment closely resembles the embodiment of FIG. 1 but differs primarily in the part of the body surrounding the button 4 (as shown in FIG. 1). The embodiment of FIG. 10 has projections 37 which extend out transversely from the body and also forward in the direction of the button. These projections 37 serve the combined purposes of both the wings 7 and the guard portions 14 of the embodiment described with reference to FIGS. 1 to 7.

FIG. 10 also shows a closure 40 for the valve 1. The closure includes a cap 41 which covers a button (not shown). It also has a plug 42 which is inserted into an opening 36 to cover the opening 36. The cap 41 and plug 42 are joined by a web 43. The closure 40 also has a pull tab 44 connected to the plug 42 to facilitate the closure being removed from the valve 1.

A recess 45 is formed in the region surrounding the button (not shown) to receive the cap 41. The recess 45 engages the cap 41 to hold it in place over the button (not shown). The web 43, which is formed from resilient material, is bent or stretched over the lip 46 of the recess 45 to allow the plug 42 to be inserted into the opening 36. The cap 41 may also be held in place in the recess by breakable filaments (not shown). The configuration of suitable filaments will be apparent to those skilled in the art.

Figure 11:
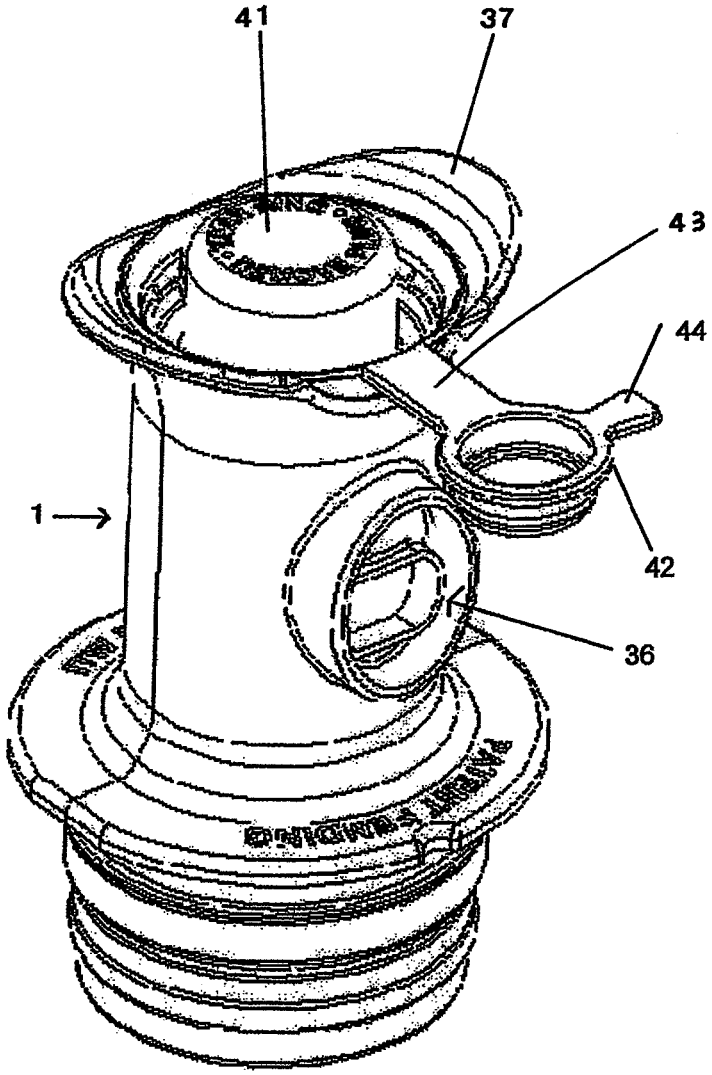
FIG. 11 is a perspective view of a valve for flowable material according to the second embodiment shown in FIG. 10, here the closure is an alternative configuration to FIG. 10.

FIG. 11 shows the same perspective view of the valve 1 as FIG. 10, but in this case the plug 42 has been removed from the opening 36. The web 43 has straightened, due to its resilience so the cap 41 and plug 42 lie in the same plane. This FIG. 11 shows the closure 40 as it would be midway to being removed. The user would pull the tab 44 to remove the closure 40 from the valve 1.

Figure 12:
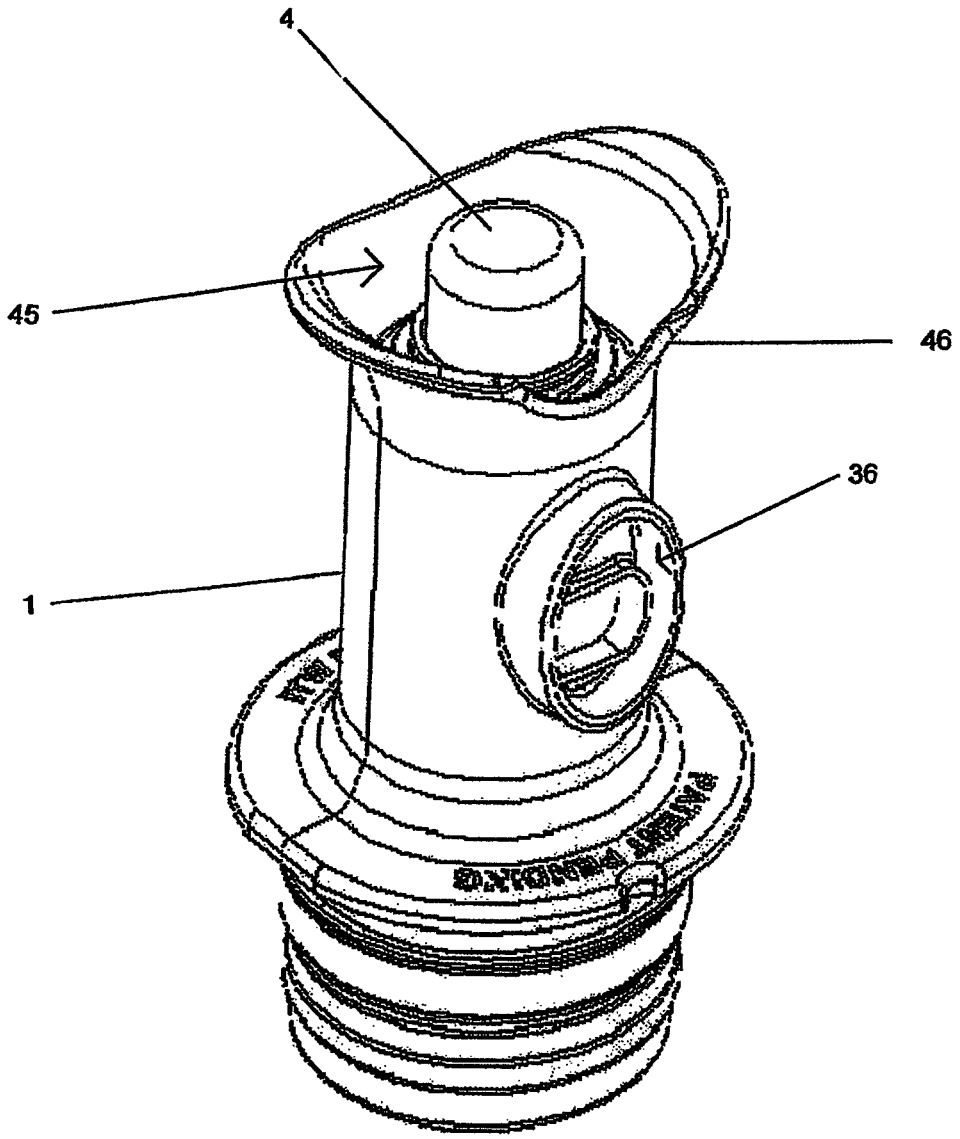
FIG. 12 is a perspective view of the third embodiment shown in FIGS. 10 and 11, here the closure is removed.

FIG. 12 shows the same perspective view of the valve 1, but in this case, the closure 40 (not shown) has been completely removed exposing the button 4. FIG. 12 shows the lip 46 of the recess 45 as cut out from the rest of the recess to allow the web (not shown) to run from the button 4 to the opening 36.

Figure 13:
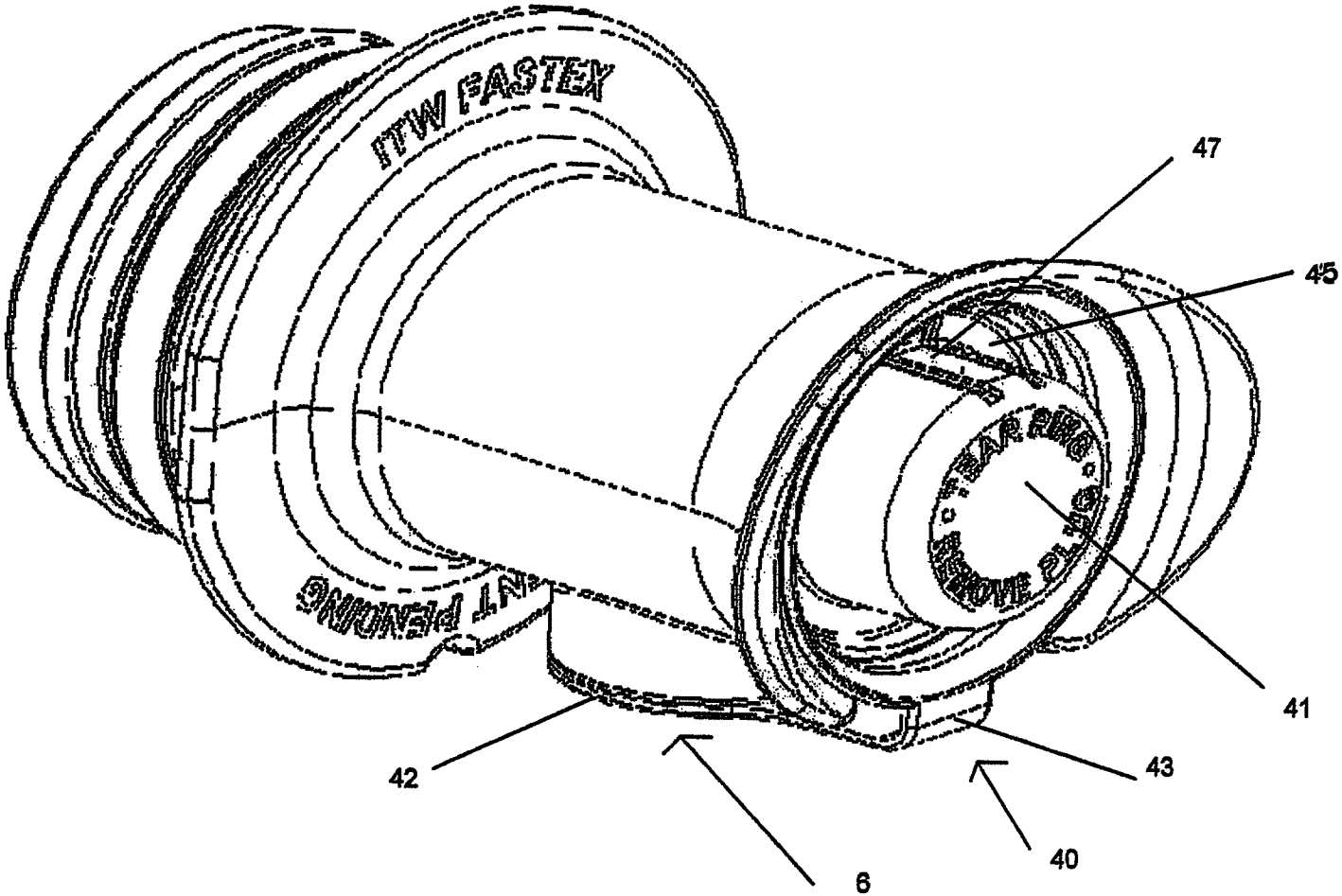
FIG. 13 is an alternative perspective view of a valve for flowable material according to the third embodiment shown in FIGS. 10 to 12.

FIG. 13 shows an alternative perspective view of the same embodiment which shows more of the recess 45 and a locking tab 47 formed in the cap 41.

Figure 14:
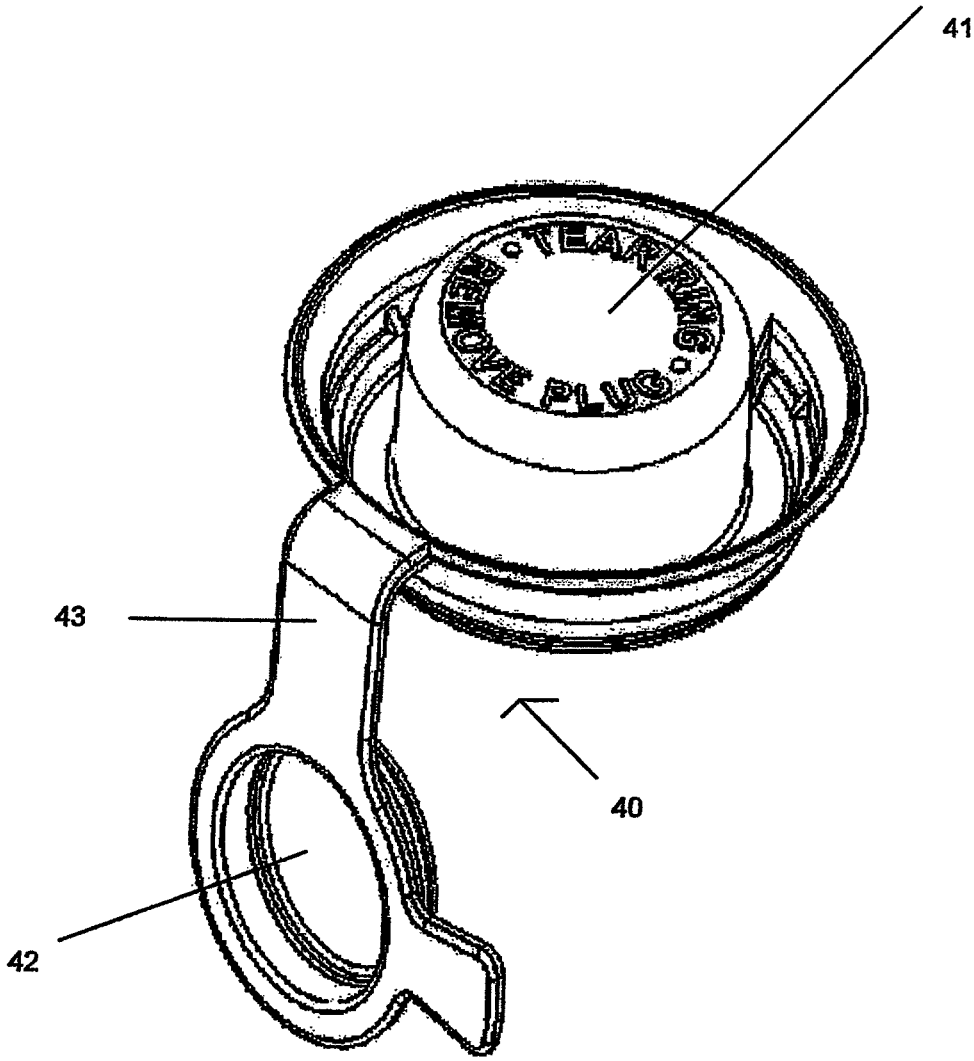
FIG. 14 shows perspective view of a closure for a valve for flowable material according to the third preferred embodiment shown in FIGS. 10 to 13.

FIG. 14 shows a closure 40 in the absence of the valve 1 (not shown). The closure 40 is shown with the cap 41 and plug 42 perpendicular to each other as they would be where the closure 40 is in use on the valve 1. This configuration involves the web 43 being bent as it would be over the lip 46 (not shown).

Figure 15:
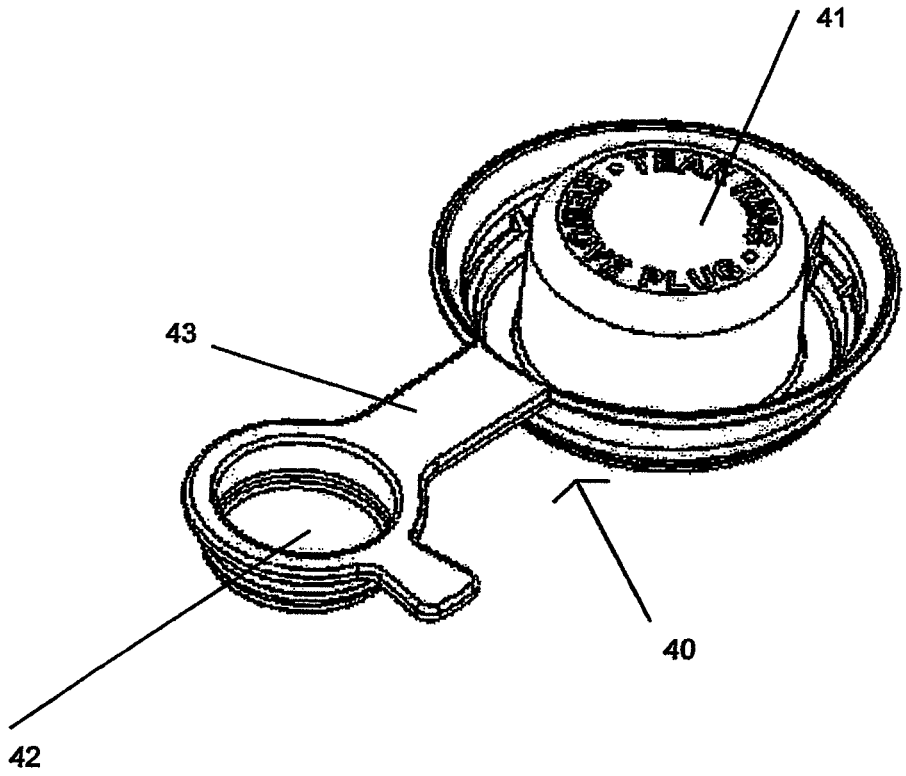
FIG. 15 shows a perspective view of a closure for a valve for flowable material according to the third preferred embodiment shown in FIGS. 10 to 14 in an alternative configuration to that figure.

FIG. 15 shows the closure 40 in a relaxed state in which the resilience of the web 43 has returned the cap 41 and plug 42 to be substantially parallel. The closure 40 would be in this configuration when mid-way to being removed from the valve 1 (not shown).

Figure 16:
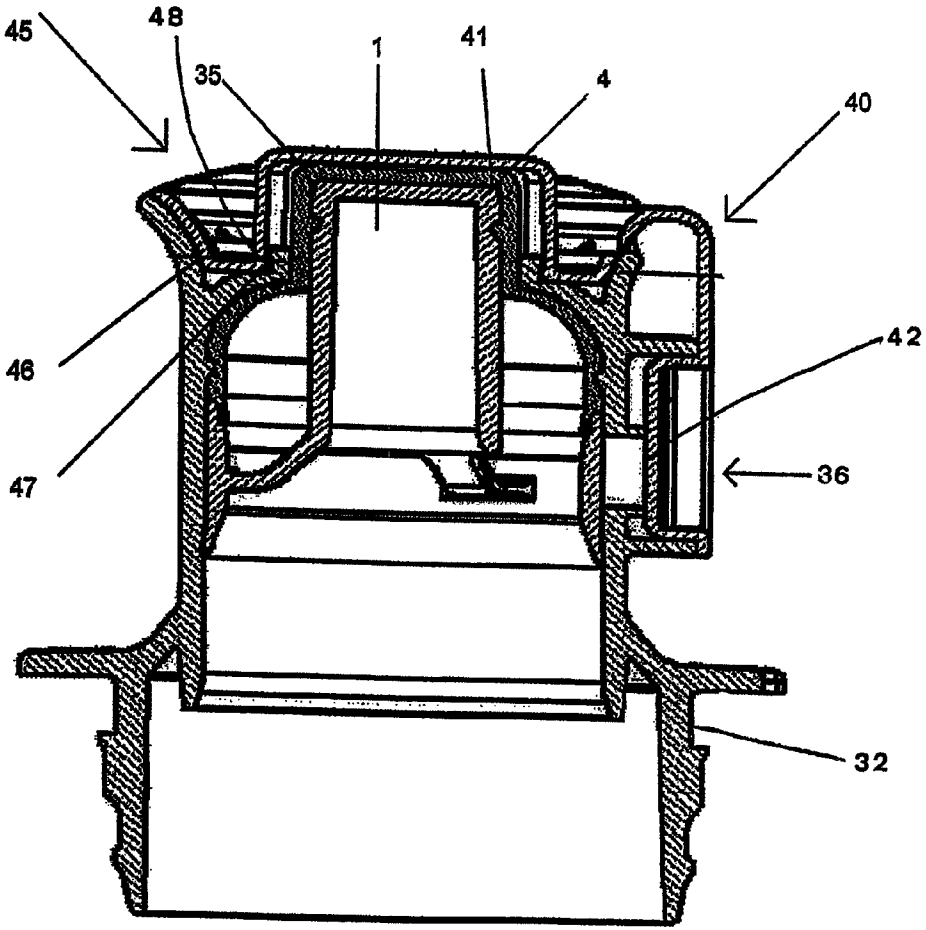
FIG. 16 shows a cross-sectional view of a valve for flowable material according to the third embodiment shown in FIGS. 10 to 13.

FIG. 16 shows a cross-sectional view of an end of the valve 1 with the closure 40 in place over the button 4 and opening 36. Although the cap 41 has been described as covering the button 4, it is apparent from FIG. 16 that the diaphragm seal 5 separates these.

The cap 41 has a flange 47 which matches the inside shape of the recess 45. The flange 47 has a sealing head 48 which is engaged by and seals with a corresponding overhang lip 49 on the body 32 of the valve 1. The resilience of the material from which the closure 40 is formed allows the overhang lip 48 and 49 to be forced over each other to remove the closure 40 from the valve 1. Otherwise, the action of the sealing head 48 and overhang lip 49 hold the cap 41 securely over the button 4.

FIG. 16 also shows that the plug 42 is formed to fit securely in the opening 36 where it is retained by friction which is assisted by the resilience of the material used for the closure 40.

Figure 17:
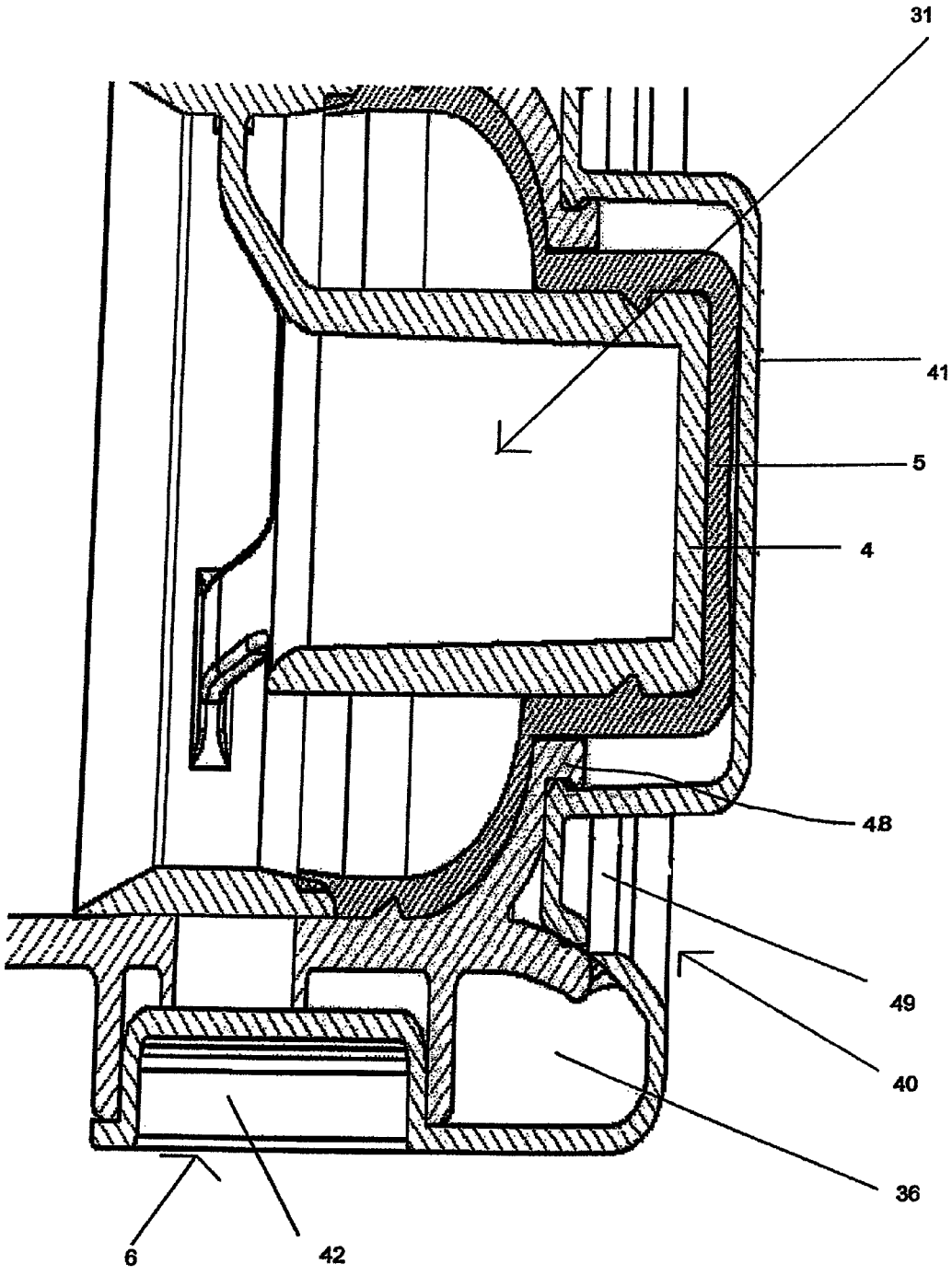
FIG. 17 shows another cross-sectional view of a valve for flowable material according to the third embodiment shown in FIGS. 10 to 16.

FIG. 17 shows a closer view of the end of the valve 1 highlighting the operation of the sealing head 48 and overhang 49. These extend around the button 34 and provide a seal for the cap 41 over the button 4.

The preferred embodiment described herein by way of example provides an advantage in economical automated assembly by the elimination of intricate parts.

The preferred embodiment described herein by way of example provides the advantage of a valve which is formed from only 3 separate parts. This means the valve is economical to produce in terms of injection moulding tools and assembly.

FIGS. 18 to 21 show a valve for flowable material according to a further embodiment of the present invention. This embodiment resembles the embodiments shown in FIGS. 1 to 7, FIGS. 8 and 9, and FIGS. 10 to 17 except that it has an extended conduit 50 which extends at an angle to the body 2 and has a membrane 51 to seal the conduit 50.

The conduit 50 extends out from the body 2 and relatively towards the button 4 at the end of the user actuatable member 16. It also extends away from the flange 8 which is typically connected, in use, to a container (not shown). Therefore, the conduit 50 acts to direct the flowable material away from the container (not shown) and towards a user. This provides additional clearance between a receptacle which may be filled with fluid via the valve 1 and a wall of a container (also not shown).

The membrane 51 may be heat sealed or adhesively sealed over the end 66 of the conduit 50. Suitable membranes will be known to those skilled in the art. Alternative means of sealing will be known to those skilled in the art also.

Figure 19:
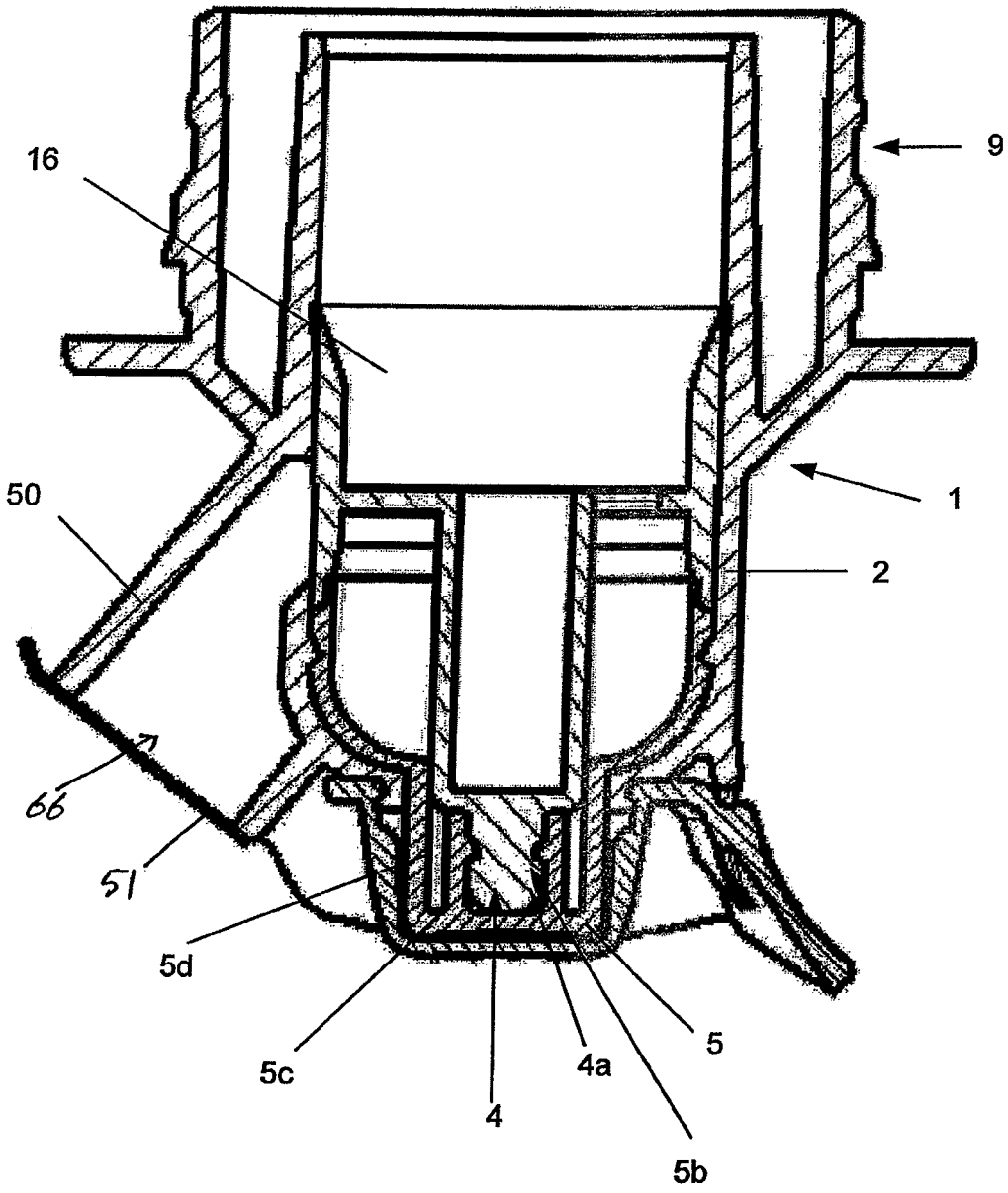
FIG. 19 shows a cutaway side elevation of a valve for flowable material according to the fourth embodiment shown in FIG. 18.

FIG. 19 shows the button 4 of this embodiment as having a narrowed end 4*a*. This narrowed end 4*a* of the button 4 is received in a recess 5*b* formed by an internal wall 5*c* of the diaphragm seal 5 to reduce the force required to double back the seal 5.

Figure 18:
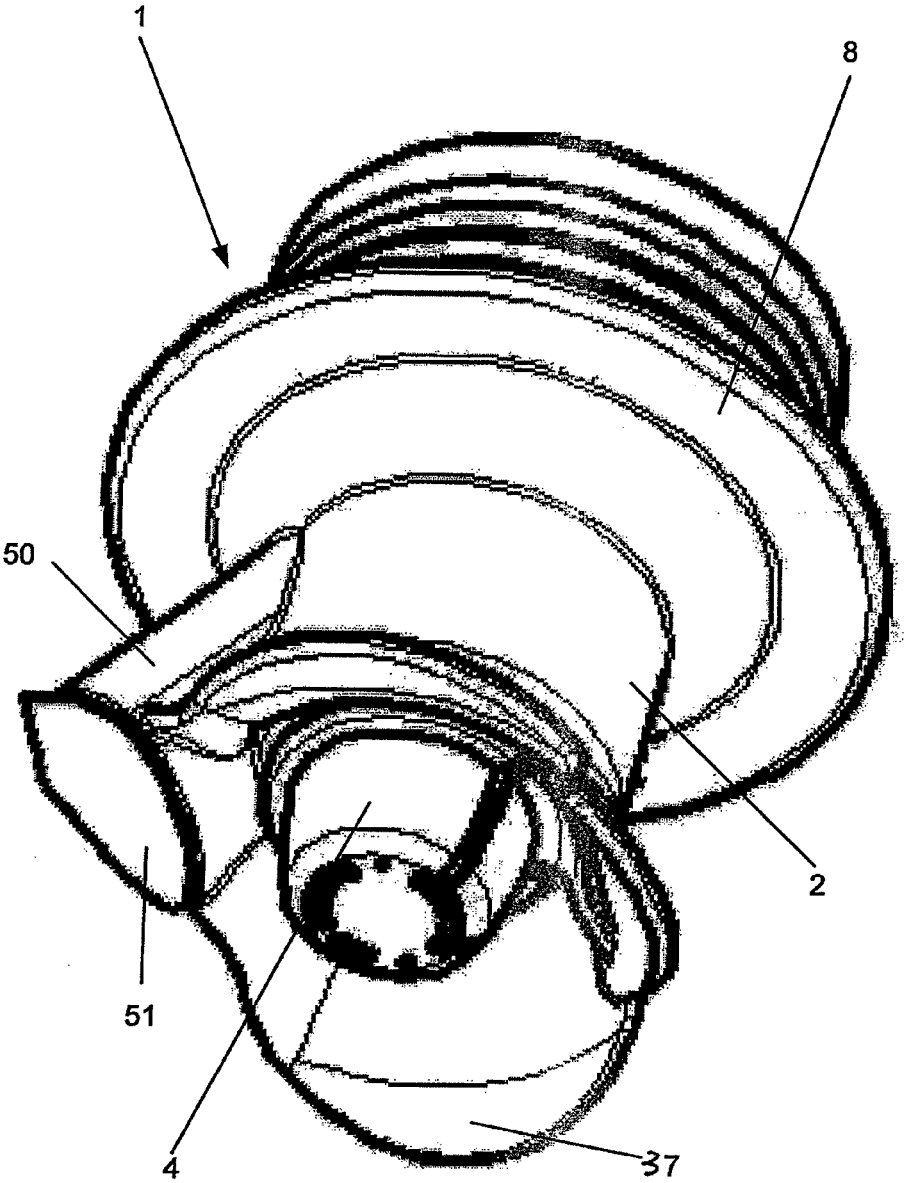
FIG. 18 shows a perspective view of a valve for flowable material according to a fourth embodiment of the present invention.
Figure 20:
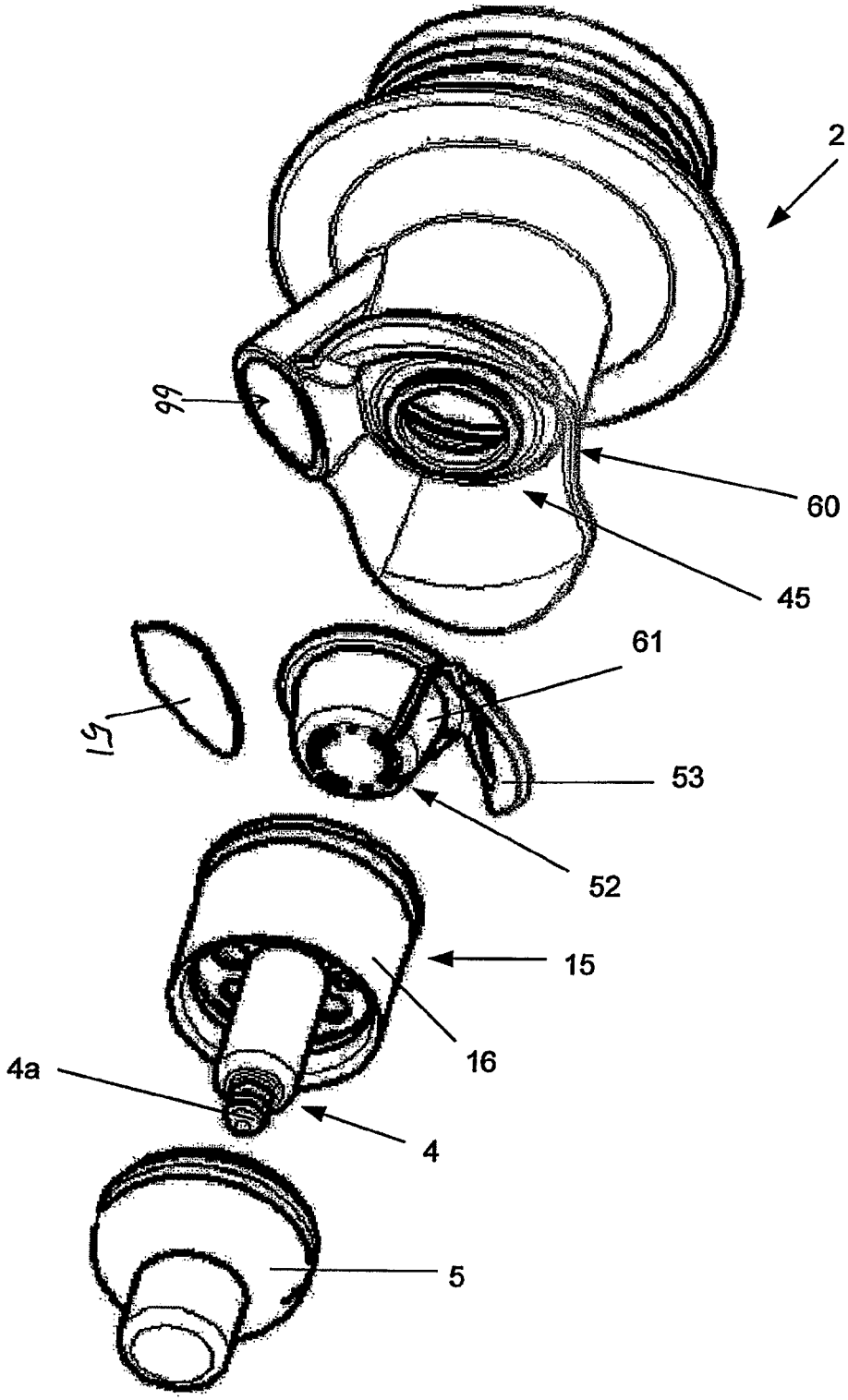
FIG. 20 shows an exploded perspective view of the component parts of a valve for flowable material according to the fourth embodiment shown in FIGS. 18 and 19.

FIG. 20 shows the disassembled components of the alternative embodiment of a valve shown in FIGS. 18 and 19. At the top of the figure is shown the body 2.

Below that is the cap 52 for the button 4. The cap 52 has an outside shape that matches the internal shape of the recess 45. The cap has a pull tab 53 which is curved to match the inner-shape of the recess 45. The recess may have a cut-out 60 to expose the pull tab 53 at an edge of the recess. This facilitates a user gripping the pull tab 53. The pull tab 53 is connected to the rest of the cap 52 by a breakaway flap 61. The breakaway flap forms part of the cap 52 until the pull tab 53 is pulled and the breakaway portion is pulled away from the rest of the cap 52. This removes the breakaway portion from part of the periphery of the cap 52. This allows the cap to flex as required to remove it from an overhang (not shown) formed around the recess 45.

Shown beside the cap 52 is a membrane 51 which seals the conduit 50. This may be any suitable membrane known to those skilled in the art. The membrane may be opened or heat sealed over the conduit.

Shown below the cap 52 is the internal member 15. The internal member has an actuatable member 16 formed at one end and a button 4 formed at the other end.

Below the internal member is shown the diaphragm seal 5.

Figure 21:
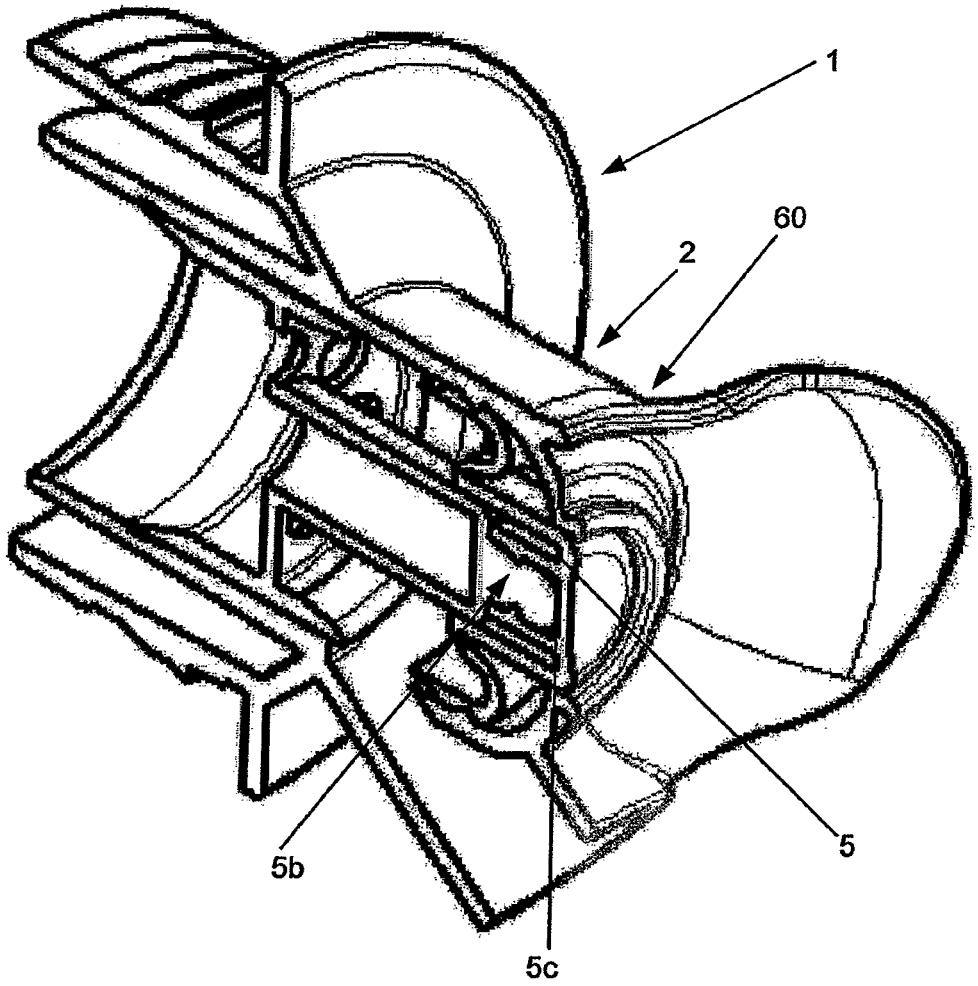
FIG. 21 shows a cutaway perspective view of a valve for flowable material according to the fourth embodiment shown in FIGS. 18 to 20, in this case, the cap for the button is removed to reveal the button underneath.

FIG. 21 depicts the components of the valve, less the cap 52, in an assembled state.

Figure 22:
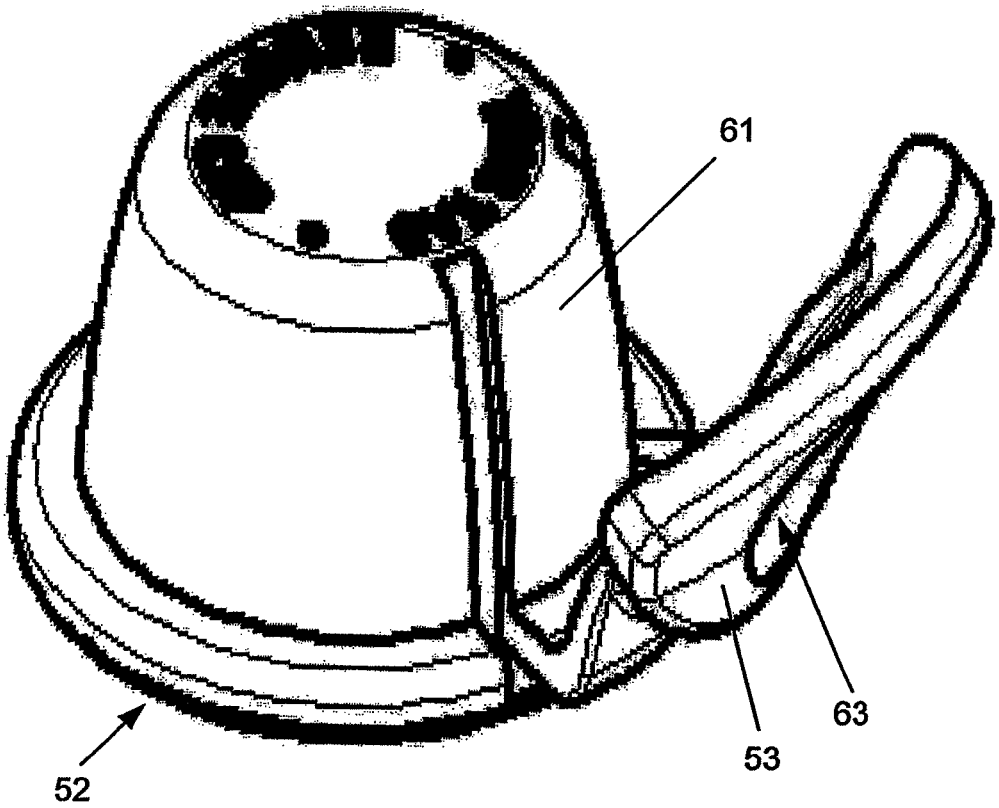
FIG. 22 shows a perspective view of a closure according to the fourth embodiment shown in FIGS. 18 to 21.

FIG. 22 shows a cap or closure 52 for the button 4. This figure shows that the pull-tab has a hole 63 formed in it to further facilitate gripping by a user.

The valve 1 according to this further alternative embodiment provides the advantage of a flow of material being directed away from a container (not shown) for improved convenience of use. It also provides the advantage of a pull tab exposed past the recess 45 to facilitate being gripped by a user.

The embodiments described herein by way of example also provides a valve which allows minimal transfer of gases through the valve into materials within the valve, and vice versa.

The alternative embodiments of the present invention provide a valve with a closure for both the button and opening that is conveniently removed.

The body and actuatable member mechanism of the preferred embodiments is intrinsically simple in shape. Many of the shapes used in the internal element 15 and body 2 are circles or near circles. The need for intricate shapes of components is eliminated in the preferred embodiment of the present invention.

Therefore, the present invention can be manufactured using relatively economical resins and moulding tools.

Aspects of the present invention have been described by way of example only and it should be appreciated that modifications and addition's may be made thereto without departing from the scope thereof as defined in the appended claims.

What we claim is:

1. A valve for a flowable material, said valve comprising:

a body having a bore formed therein, the bore having a flow opening on a side of the bore;

an actuatable member (i) having an end portion protruding outwardly from the bore and (ii) movable along the bore to open or close the flow opening in an open position or in a closed position, respectively; and a diaphragm seal engageable with the actuatable member, said diaphragm seal including a first portion covering the end portion of the actuatable member and a second portion circumferentially extending around the first portion, wherein the second portion of the diaphragm seal is directly abutted against an end of the body in the closed position to stop the flow of the material within the valve, the first portion of the diaphragm seal is directly abutted against the end portion of the actuatable member and the end of the body in the open position so as to stop the material from being transferred through the diaphragm seal, the diaphragm seal is deformable, and the diaphragm seal is folded to define two folds between the body and the actuatable member when the actuatable member is in the open position.

2. The valve as claimed in claim 1, wherein the actuatable member has an outer profile of a complementary shape to said bore.

3. The valve as claimed in claim 1, wherein the diaphragm seal comprises a rib.

4. The valve as claimed in claim 3, wherein the rib is formed on the actuatable member.

5. The valve as claimed in claim 1, wherein the diaphragm seal is configured to bias the actuatable member towards the closed position where the actuatable member fully covers said flow opening and prevents the flow of material from passing through the flow opening.

6. The valve as claimed in claim 1, wherein the body includes an opening allowing the actuatable member to protrude therethrough.

7. The valve as claimed in claim 6, further comprising a cover adapted to be connected to the body and sit over the actuatable member.

8. The valve as claimed in claim 7, further comprising a pull tab connected to the cover.

9. The valve as claimed in claim 7, wherein the body includes an overhang in the vicinity of the opening for the actuatable member.

10. The valve as claimed in claim 7, wherein said cover comprises:

an actuatable member covering portion adapted to cover the actuatable member;

a plug adapted to close the flow opening; and a web portion connecting said actuatable member covering portion and said plug.

11. The valve as claimed in claim 6, further comprising a cover adapted to be connected to the body and cover the actuatable member, said cover including tamper evident elements which are breakable to allow part of the cover to be removed from the body to expose the actuatable member.

12. The valve as claimed in claim 1, wherein the diaphragm seal comprises a biasing element biasing the actuatable member forward to the closed position.

13. The valve as claimed in claim 1, wherein the diaphragm seal is formed from an elastomer material.

14. The valve as claimed in claim 1, wherein the body and diaphragm seal are formed with co-operating or complementary shapes at regions at which the body and the diaphragm seal abut.

15. The valve as claimed in claim 1, wherein the diaphragm seal defines a recess to receive the end portion of the actuatable member.

16. The valve as claimed in claim 1, wherein the end portion of the actuatable member includes a button.

17. The valve as claimed in claim 16, further comprising at least one projection formed on the body and projecting substantially transverse to the button which is adapted for a user to grip when depressing the button.

18. The valve as claimed in claim 1, wherein the body includes at least one guard protrusion positioned adjacent to the actuatable member and extending substantially in a moving direction of said actuatable member.

19. A valve for a flowable material, said valve comprising:

a body having a bore formed therein, the bore having a flow opening on a side of the bore;

an actuatable member (i) having an end portion protruding outwardly from the bore and (ii) movable along the bore to open or close the flow opening in an open position or in a closed position, respectively; and a diaphragm seal engageable with the actuatable member, said diaphragm seal including a first portion covering the end portion of the actuatable member and a second portion circumferentially extending around the first portion, wherein the second portion of the diaphragm seal is directly abutted against an end of the body in the closed position to stop the flow of the material within the valve, the first portion of the diaphragm seal is directly abutted against the end portion of the actuatable member and the end of the body in the open position so as to stop the material from being transferred through the diaphragm seal, the diaphragm seal is deformable, and wherein the diaphragm seal is adapted to be fitted within an end of the bore.

20. The valve as claimed in claim 19, further comprising at least one rib or groove between the diaphragm seal and the bore so as to fasten the diaphragm seal within the bore.

21. The valve as claimed in claim 20, further comprising at least one further rib or groove between the diaphragm seal and the actuatable member to fasten the diaphragm seal over the actuatable member.

22. A valve for a flowable material, said valve comprising:

a body having a bore formed therein, the bore having a flow opening on a side of the bore;

an actuatable member (i) having an end portion protruding outwardly from the bore and (ii) movable along the bore to open or close the flow opening in an open position or in a closed position, respectively; and a diaphragm seal engageable with the actuatable member, wherein the diaphragm seal is directly abutted against the body in the closed position to stop the flow of the material within the valve, the diaphragm seal is directly abutted against the end portion of the actuatable member in the open position so as to stop the material from being transferred through the diaphragm seal, and the actuatable member includes at least one conduit formed therethrough.

23. The valve as claimed in claim 22, wherein, when the flow opening is not covered by the actuatable member, a flow-path for the material is provided through the actuatable member.

24. The valve as claimed in claim 22, further comprising an outlet conduit connected to the conduit of the actuatable member and extending from the flow opening, said outlet conduit adapted to direct flowable material away from the flow opening.

25. The valve as claimed in claim 24, wherein the outlet conduit is inclined to the body.

26. The valve as claimed in claim 25, wherein the outlet conduit is inclined at substantially 45 degrees to a central axis of the bore.

27. The valve as claimed in claim 24, further comprising a removable membrane over an end of the outlet conduit for sealing the outlet conduit.

28. A valve for a flowable material, said valve comprising:

a body having a bore formed therein, the bore having a flow opening on a side of the bore;

an actuatable member (i) having an end portion protruding outwardly from the bore and (ii) movable along the bore to open or close the flow opening in an open position or in a closed position, respectively; and a diaphragm seal engageable with the actuatable member, said diaphragm seal including a first portion covering the end portion of the actuatable member and a second portion circumferentially extending around the first portion, wherein the second portion of the diaphragm seal is directly abutted against an end of the body in the closed position to stop the flow of the material within the valve, the first portion of the diaphragm seal is directly abutted against the end portion of the actuatable member and the end of the body in the open position so as to stop the material from being transferred through the diaphragm seal, the diaphragm seal is deformable, the second portion of the diaphragm seal is folded onto itself when the actuatable member is in the open position where the actuatable member does not cover the flow opening, and the second portion of the diaphragm seal is folded onto itself inwardly to define a fold between the body and the actuatable member in a direction perpendicular to a moving direction of the actuatable member when the actuatable member is in the open position.

* * * * *